US007614430B2

(12) United States Patent
Bergman et al.

(10) Patent No.: US 7,614,430 B2
(45) Date of Patent: Nov. 10, 2009

(54) STORAGE BAG WITH FLUID SEPARATOR

(75) Inventors: Carl L. Bergman, Loveland, OH (US); Michael Borchardt, Naperville, IL (US); Andrew E. Neltner, Cincinnati, OH (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 12/185,614

(22) Filed: Aug. 4, 2008

(65) Prior Publication Data

US 2008/0289719 A1 Nov. 27, 2008

Related U.S. Application Data

(60) Division of application No. 11/166,574, filed on Jun. 24, 2005, now Pat. No. 7,422,369, which is a continuation-in-part of application No. 11/039,735, filed on Jan. 20, 2005.

(51) Int. Cl.

| | |
|---|---|
| ***B65B 31/04*** | (2006.01) |
| ***B65D 33/01*** | (2006.01) |
| *B65D 30/24* | (2006.01) |
| *B65D 81/20* | (2006.01) |

(52) U.S. Cl. ..... 141/8; 141/65; 383/103; 383/118; 206/524.8

(58) Field of Classification Search ..... 141/8, 141/65; 383/100, 103, 118; 206/524.8
See application file for complete search history.

(56) References Cited

U.S. PATENT DOCUMENTS

| | | | | |
|---|---|---|---|---|
| 2,778,173 | A | 1/1957 | Taunton | |
| 3,430,842 | A | 3/1969 | Gennosuke | |
| 3,559,847 | A | 2/1971 | Goodrich | |
| 3,849,814 | A | 11/1974 | Ross | |
| 4,399,576 | A | 8/1983 | Callaway | |
| 4,640,425 | A | 2/1987 | Cabernoch | |
| 4,756,422 | A | 7/1988 | Kristen | |
| 5,142,970 | A | 9/1992 | ErkenBrack | |
| 5,307,955 | A | 5/1994 | Viegas | |
| 5,649,643 | A | 7/1997 | Ridgeway | |
| 5,881,881 | A * | 3/1999 | Carrington | 206/524.8 |
| 6,059,457 | A * | 5/2000 | Sprehe et al. | 383/103 |
| 6,149,304 | A | 11/2000 | Hamilton et al. | |
| 6,357,915 | B2 | 3/2002 | Anderson | |
| 6,394,652 | B2 | 5/2002 | Meyer et al. | |
| 6,575,191 | B2 | 6/2003 | Skeens et al. | |
| 6,604,634 | B2 | 8/2003 | Su | |
| 6,634,384 | B2 * | 10/2003 | Skeens et al. | 206/524.8 |
| 7,232,108 | B2 * | 6/2007 | Motonaka et al. | 383/103 |

(Continued)

*Primary Examiner*—Gregory L Huson
*Assistant Examiner*—Nicolas A Arnett
(74) *Attorney, Agent, or Firm*—Thomas C. Feix

(57) ABSTRACT

The storage bag includes an interior volume for containing food items and a one-way valve element through which air from the interior volume can be evacuated. To prevent fluids and juices from the stored food items from contaminating the valve element, a separator defining a chamber is included that sealingly connects the valve element to the interior volume. In the separator, fluids and juices separate from the evacuating air by gravitational separation and are returned to the interior volume. In an embodiment, to facilitate packaging and distribution of multiple storage bags, the separator is adjustable between an expanded position for providing the chamber and a collapsed position substantially eliminating the chamber. In an embodiment, the separator may be comprised of elastically expandable material.

3 Claims, 17 Drawing Sheets

U.S. PATENT DOCUMENTS

2003/0178066 A1* 9/2003 Skeens et al. ..... 206/524.8
2004/0000503 A1 1/2004 Shah et al.
2005/0286808 A1* 12/2005 Zimmerman et al. ..... 383/43
2006/0131328 A1* 6/2006 Anderson ..... 222/95
2006/0193540 A1* 8/2006 Borchardt ..... 383/100

* cited by examiner

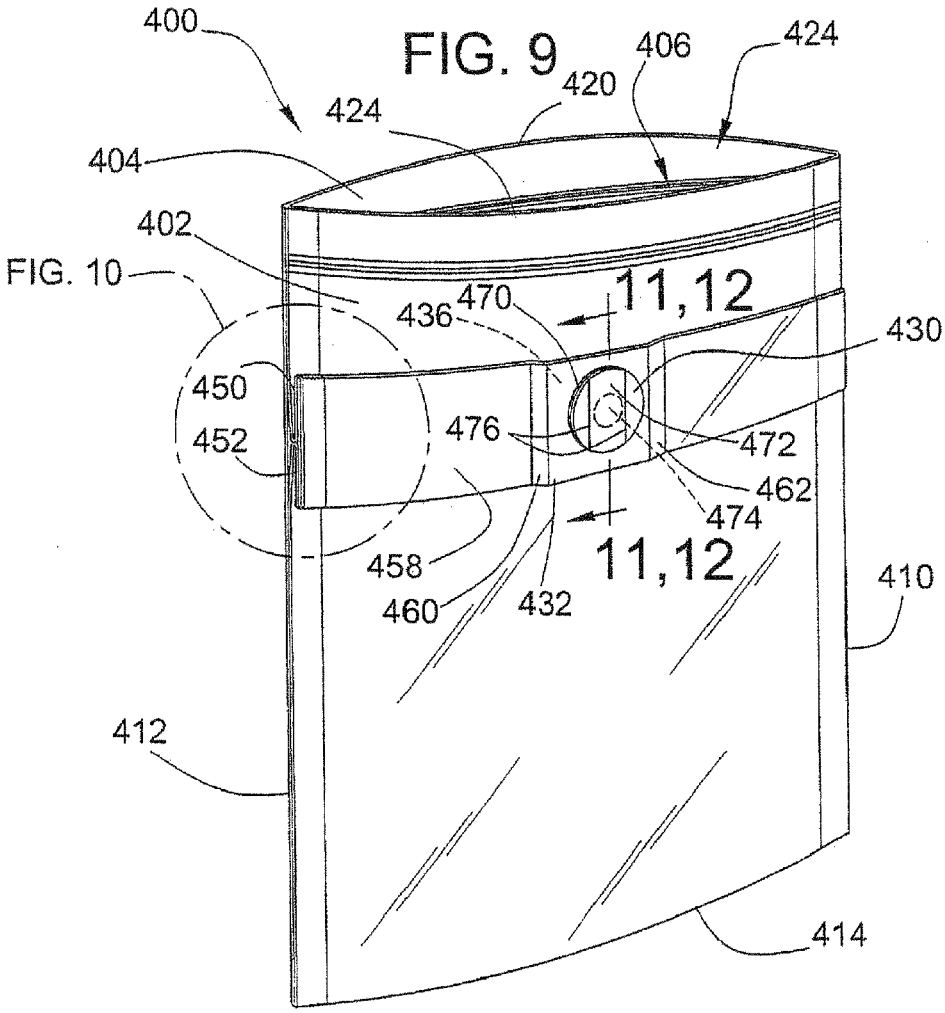
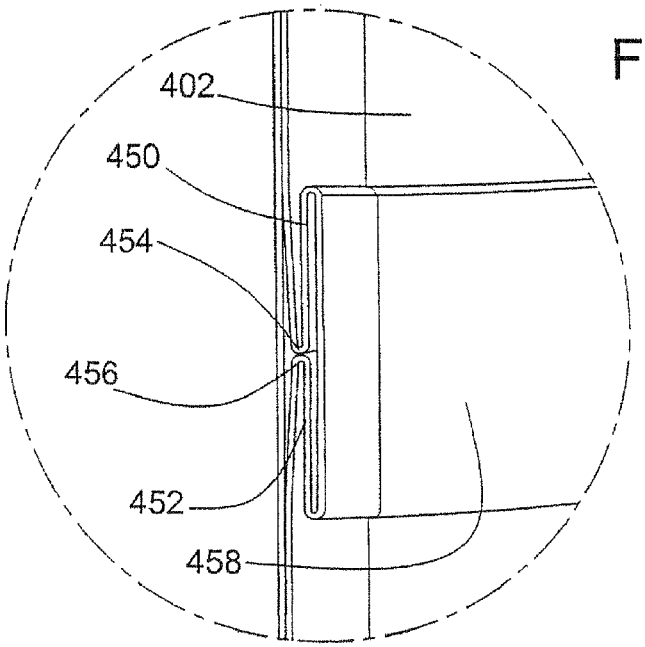
FIG. 10

FIG. 24
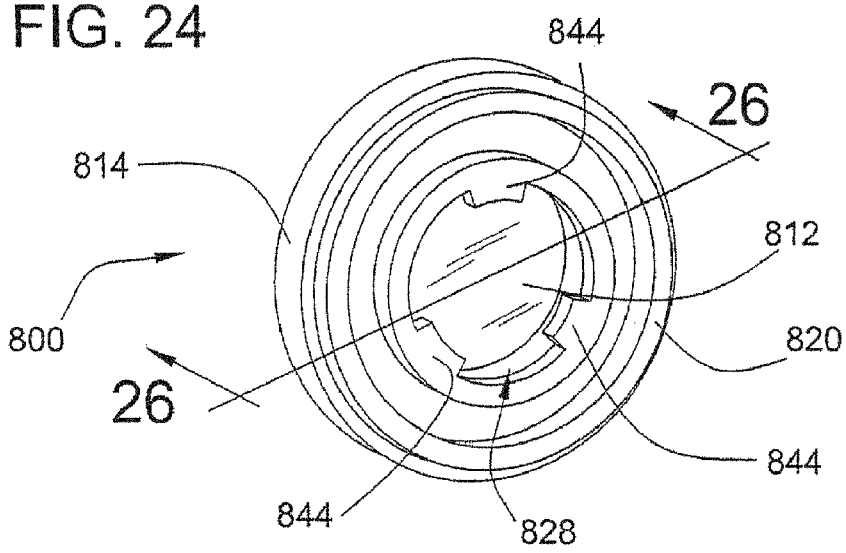
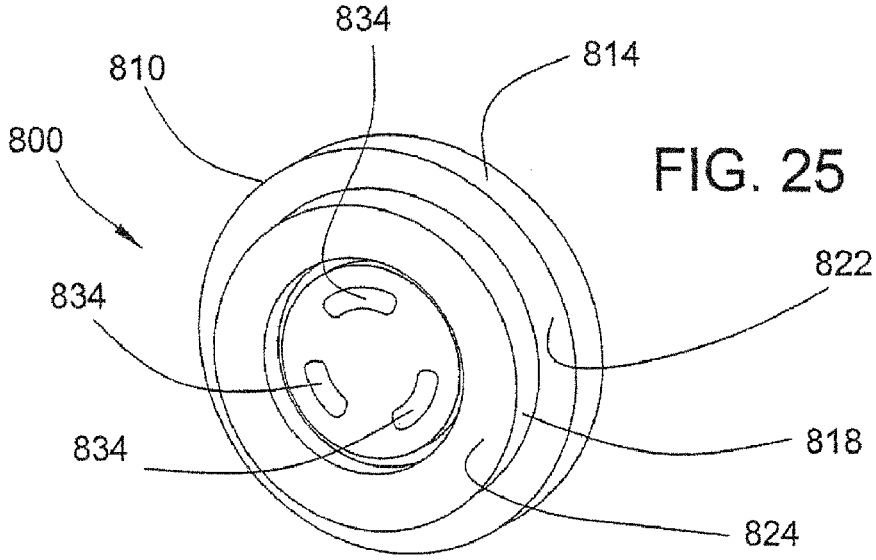
FIG. 25
FIG. 26
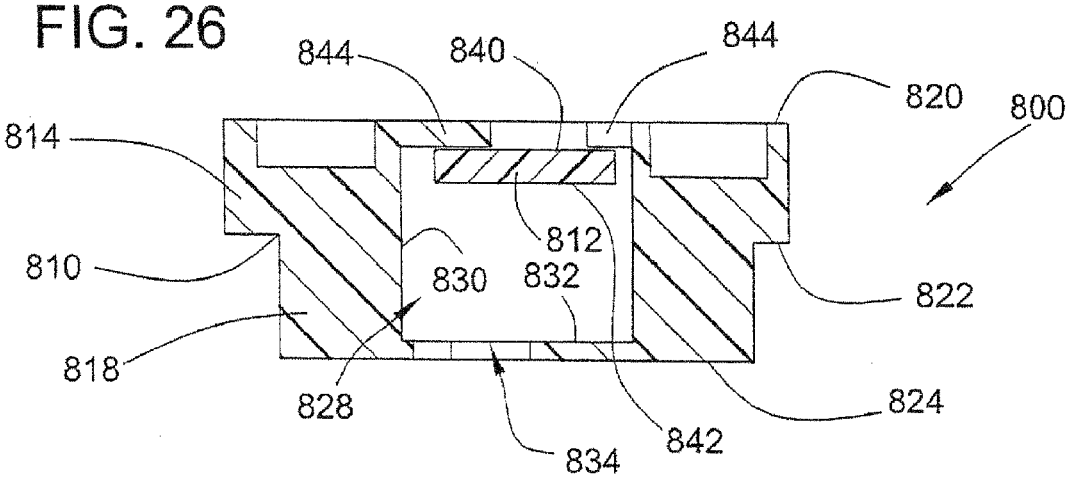

STORAGE BAG WITH FLUID SEPARATOR

CROSS-REFERENCE TO RELATED PATENT APPLICATIONS

This application is a divisional of application Ser. No. 11/166,574, filed on Jun. 24, 2005 now U.S. Pat. No. 7,422,369; which is a continuation-in-part of application Ser. No. 11/039,735, filed on Jan. 20, 2005, the disclosure of which is herein incorporated by reference in its entirety.

FIELD OF THE INVENTION

This invention pertains generally to storage containers and more particularly to flexible, thermoplastic, storage bags designed to be sealed and evacuated. The invention finds particular applicability in the field of food storage.

BACKGROUND OF THE INVENTION

Storage bags are commonly used for a variety of purposes such as storing food items. Such storage bags are typically made from a flexible, low cost, thermoplastic material that defines an interior volume into which food items can be inserted. To preserve the inserted food, the storage bag may also include a distinct closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, it is known to provide a one-way valve element or other evacuation device communicating with the interior volume. The one-way valve element allows for the evacuation of trapped air while preventing the ingress of air from the surrounding volume into the interior volume. The one-way valve element may be activated by applying compressive pressure to the flexible sidewalls to force air from the interior volume.

Often, the stored food items contain fluids or juices that, during evacuation, may be drawn into and thereby contaminate the valve element. As will be appreciated, the contaminated valve element may result in sanitary issues and may not function properly. Additionally, the fluids or juices may also be drawn through the valve element and into the vacuum source or otherwise ejected into the environment, causing additional sanitary or operational problems. The inventive storage bag remedies these and other problems.

BRIEF SUMMARY OF THE INVENTION

The invention provides a storage bag configured with a separator that causes separation of fluids and juices from air being evacuated through the one-way valve element. The valve element communicates with the interior volume via the separator such that evacuating air must pass through the separator. By removing fluids and juices from the evacuating air before the air passes through the one-way valve element, contamination of the valve element is avoided.

In an aspect of the invention, the separator is configured as an excess piece of flexible material that sealingly connects the valve element to a smooth sidewall of the storage bag. The flexible separator is adjustable between a collapsed position and an expanded position. In the collapsed position, the valve element is generally located within the plane of the sidewall to enable compact stacking and folding of multiple bags. In the expanded position, the separator expands to define a chamber that raises or spaces the valve element from the sidewall. As air is drawn through the chamber, fluids and juices are caused to gravitationally separate from the evacuating air, condense together, and are returned to the interior volume.

In another aspect of the invention, the separator is formed as a region of elastically resilient material joined to the sidewall of the storage bag. To provide an aesthetic appearance, the elastic region typically forms a smooth and continuous surface with the sidewall. The one-way valve element is joined to the elastic region and is thereby connected to the rest of the sidewall. The elastic region can elastically expand and contract with respect to the sidewall thereby moving the valve element away from or into the plane of the sidewall. When expanded, the region also provides a chamber communicating between the interior volume and the valve element. Fluids and juices entrained in air evacuating through the chamber can separate out and return to the interior volume.

An advantage of the invention is that it provides a storage bag configured to prevent contamination of a one-way valve element by separating fluids from evacuating air. Another advantage is that, in an aspect, the bag including the separator is made from flexible material to allow collapsing and folding of the bag for compact packaging during distribution. Another advantage is that, in an embodiment, the separator can elastically expand and recover with respect to the sidewall so as to provide an aesthetically pleasing appearance. Another advantage is that in an embodiment, the separator does not interfere with packaging and dispensing of the finished bag. The invention has another advantage of providing to a user a visual indication that the vacuum source is evacuating the storage bag. These and other advantages and features of the invention will become apparent from the detailed description and the accompanying drawings.

BRIEF DESCRIPTION OF THE DRAWINGS

FIG. 9 is a perspective view of another embodiment of the storage bag having a one-way valve element and a separator for separating fluids and juices from evacuating air, where the separator is provided by forming opposing Z-folds into the sidewall of the bag.

FIG. 10 is a detailed view of the indicated portion of FIG. 9, illustrating the arrangement of the opposing Z-folds.

FIG. 24 is a front perspective view of an embodiment of a one-way valve element for use with flexible bags of the invention.

FIG. 25 is a rear perspective view of the one-way valve element of FIG. 24.

FIG. 26 is a cross-sectional view through the one-way valve element, as taken along line 26-26 of FIG. 24.

DETAILED DESCRIPTION OF THE INVENTION

Figure 1:
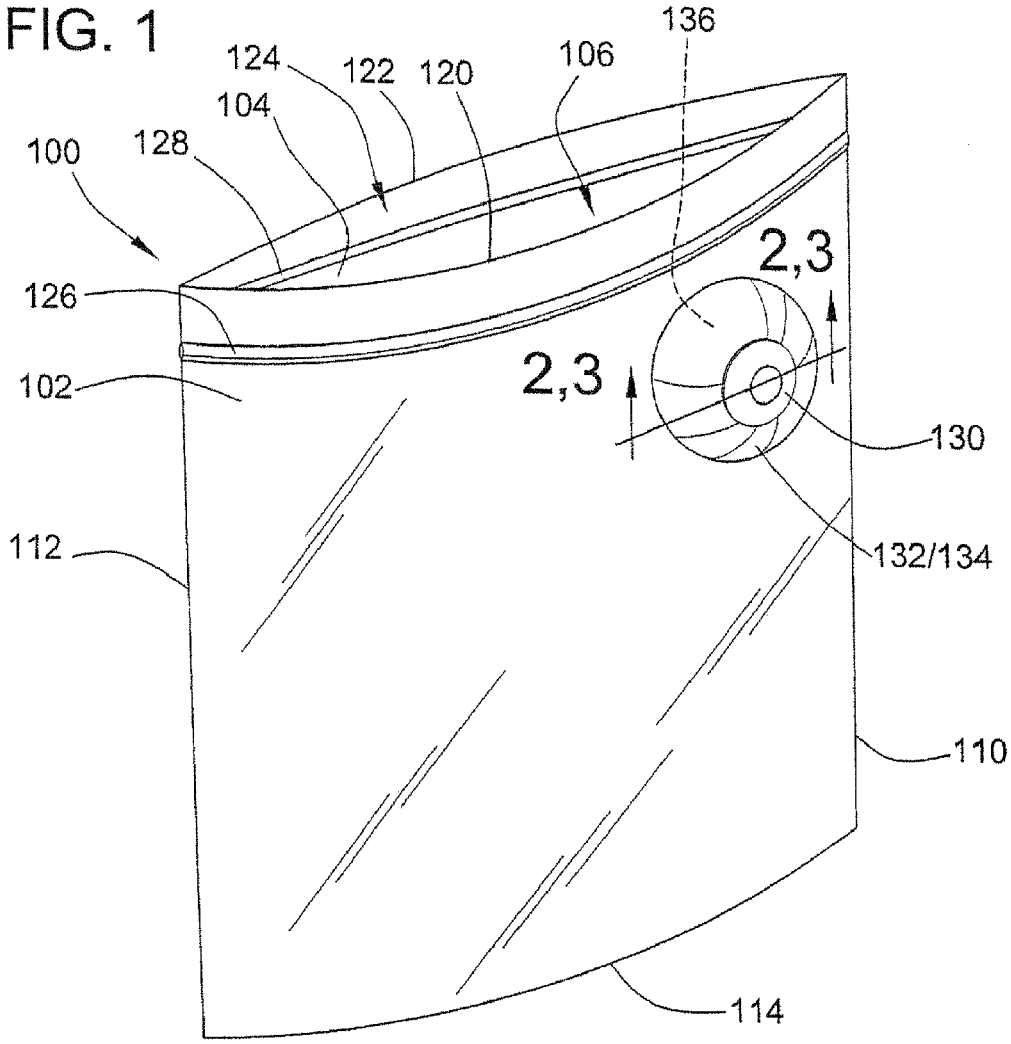
FIG. 1 is a perspective view of a storage bag designed in accordance with the teachings of the invention, the storage bag having a one-way valve element and a separator for separating fluids and juices from evacuating air.

Now referring to the drawings, wherein like reference numbers refer to like elements, there is illustrated in FIG. 1 a storage bag 100 for storing items such as food stuffs. In the illustrated embodiment, the storage bag 100 is made from a first sidewall 102 and an opposing second sidewall 104 overlying the first side wall to define an interior volume 106 therebetween. The first and second sidewall 102, 104 are joined along a first side edge 110, a parallel or non-parallel second side edge 112, and a closed bottom edge 114 that extends between the first and second side edges. The first and/or second sidewalls 102, 104 are preferably made from a flexible or pliable thermoplastic material formed or drawn into a smooth, thin walled sheet. Examples of suitable thermoplastic material include high density polyethylene, low density polyethylene, polypropylene, ethylene vinyl acetate, nylon, polyester, polyamide, ethylene vinyl alcohol, and can be formed in single or multiple layers. The thermoplastic material can be transparent, translucent, opaque, or tinted. Furthermore, the material used for the sidewalls can be a gas impermeable material. The sidewalls 102, 104 can be joined along the first and second side edges 110, 112 and bottom edge 114 by any suitable process such as, for example, heat sealing.

For accessing the interior volume 106, the top edges 120, 122 of the first and second sidewalls 102, 104 opposite the bottom edge 114 remain un-joined to define an opening 124. To seal closed the opening 124, first and second interlocking fastening strips 126, 128 can be attached to the interior surfaces of the respective first and second sidewalls 102, 104. The first and second fastening strips 126, 128 extend generally between the first and second side edges 110, 112 parallel to and spaced below the top edges 120, 122. In other embodiments, the bag 100 can include a movable slider straddling the fastening strips 126, 128 to facilitate occluding and deocculding of the opening 124. In other embodiments, instead of fastening strips, the first and second sidewalls can be configured with pressure sensitive or cold seal adhesives (such as those disclosed in U.S. Pat. No. 6,149,304, herein incorporated by reference in its entirety), heat-sealing, or cling, to seal the open top edge.

To evacuate the bag of latent or entrapped air after the opening has been sealed closed, a one-way valve element 130 is provided that communicates with the interior volume 106. In one embodiment, the one-way valve element 130 is configured to open under an applied pressure differential thereby allowing air from the interior volume 106 to escape and to close after elimination or reduction of the pressure differential thereby preventing the ingress of environmental air into the interior volume. In accordance with the invention, the one-way valve element is connected to the rest of the bag via a separator to separate fluids and juices from evacuating air.

Figure 2:
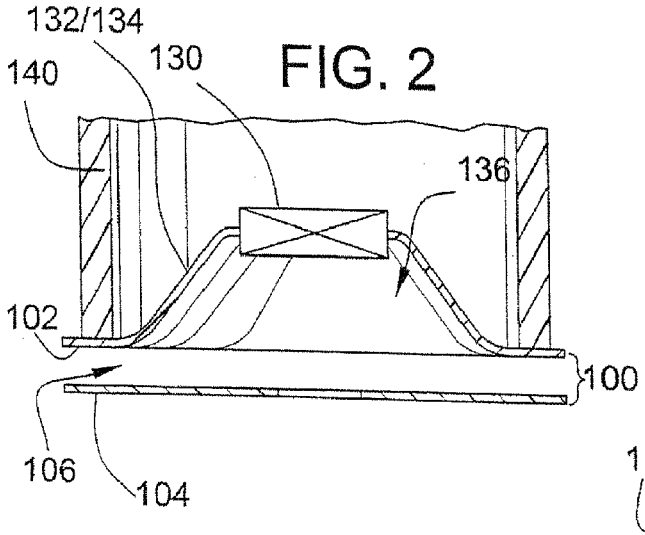
FIG. 2 is a cross-sectional view through the valve element and the separator as taken along line 2-2 of FIG. 1, the valve element and separator being acted upon by a nozzle during evacuation and the separator shown in an expanded position.

As illustrated in FIGS. 1 and 2, the separator 132 is formed from a piece of excess material in the shape of a thin-walled dome 134 that is joined along its base to a first sidewall 102 and protrudes outward therefrom. The thin-walled dome 134 of excess material surrounds and defines an enclosed chamber 136 that communicates with the interior volume 106. The valve element 130 is sealingly joined to the apex of the dome 134 and is thereby connected to and spaced-apart from the first sidewall 102.

Referring to FIG. 2, air drawn or forced from the interior volume 106 must pass through the chamber 136 to reach and escape through the valve element 130. In the chamber 136, fluids and juices entrained in the evacuating air from the interior volume are removed by gravitational separation and returned to the interior volume 106. More specifically, the pressure, velocity, and generally vertical direction of the air being drawn or forced through the chamber 136 interact to cause the fluids and juices to condense into droplets that can remain in the chamber during evacuation and return under the influence of gravity to the interior volume 106. This is facilitated by the greater density of the fluids as compared to air and due to the resulting condensation droplets' inability to traverse the chamber. Additionally, contacting the evacuating air generally along the inner surfaces of the sidewalls 102, 104 and causing the evacuating air to turn towards the valve element 130 along the inner surface of the excess material making up the separator 132 facilitates separation and condensation of the fluids and juices. Hence, the evacuating air actually passing through the valve element 130 is relatively devoid of entrained fluids and juices in liquid or droplet form, thereby preventing contamination of the valve element. The size and shape of the chamber 136 can be optimized with respect to the shape of the interior volume 106, first sidewall 102, and valve element 130 to maximize the separation of fluids and juices.

Figure 3:
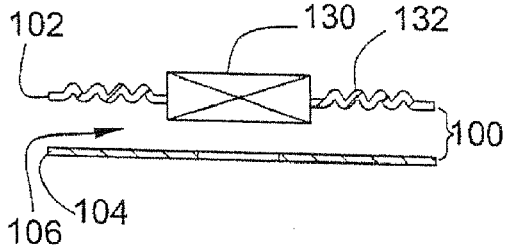
FIG. 3 is a cross-sectional view through the valve element and the separator as taken along line 3-3 of FIG. 1, the separator shown in a collapsed position.

Referring to FIGS. 2 and 3, to allow for folding and packaging of the storage bag 100, the separator 132 is preferably adjustable between a collapsed position and an expanded position. The separator 132 can be made from the same or similar flexible or pliable material as the first or second sidewalls 102, 104. When the bag 100 is placed atop a generally flat surface, the separator 132 can collapse from the dome shape and bunch or fold together about the valve element 130 so that the valve element is generally located within the plane of the first sidewall 102, as shown in FIG. 3. When the separator 132 is in the collapsed position, the chamber is by and large eliminated. Hence, the first and second sidewalls 102, 104 are generally parallel and can be pressed together to eliminate the interior volume 106 and flatten the bag 100. As will be appreciated, multiple flattened bags can be compactly stacked atop one-another for packaging and distribution.

In one embodiment, to make the separator 132 "pop-up" and thereby place the separator into its expanded position, referring back to FIG. 2, a pressure differential is applied across the first sidewall 102 proximate the valve element 130. The pressure differential can be generated by the same vacuum source used to evacuate air from the bag 100 or from a different vacuum source. Specifically, a generally tubular nozzle 140 is placed against the first sidewall 102 generally about the valve element 130 and the separator 132. The first end of the nozzle 140 can be pressed against the first sidewall 102 while the second end of the nozzle communicates with a vacuum source. When the vacuum source is activated, the pressure differential between the interior volume 106 and the nozzle 140 causes the separator 132 to expand and protrude in the shape of the thin-walled dome 134 from the first sidewall 102. The expanding separator 132 defines the chamber 136 that raises or spaces the valve element 130 apart from the first sidewall 102 and in which the separation of fluids and juices from the evacuating air occurs. After evacuation of the interior volume 106, the valve element 130 will close as the pressure differential is reduced or eliminated and the nozzle 140 can be removed. After removal of the nozzle, the separator 132 can be collapsed by vacuum from inside the bag or by external hand pressure to force the remaining air in the chamber 136 back into the interior volume. In other applications, it will be appreciated that, rather than using a nozzle and an attached vacuum source, evacuation of the interior volume can occur by pressing the first and second sidewalls together by hand thereby forcing air into and expanding the separator.

Referring to FIGS. 2 and 3, the excess material for the separator 132 is preferably provided from the same sheet of material as used for the first sidewall 102. For example, the pliable material of the first sidewall 102 can be stamped, thermoformed or otherwise displaced or formed to provide the dome-shape 134 of the separator 132. Hence, the separator 132 is integral with the first sidewall 102 and can likewise be made of any suitable thermoplastic material such as, for example, high density polyethylene, low density polyethylene, polypropylene, ethylene vinyl acetate, and can be formed in single or multiple layers.

Figure 4:
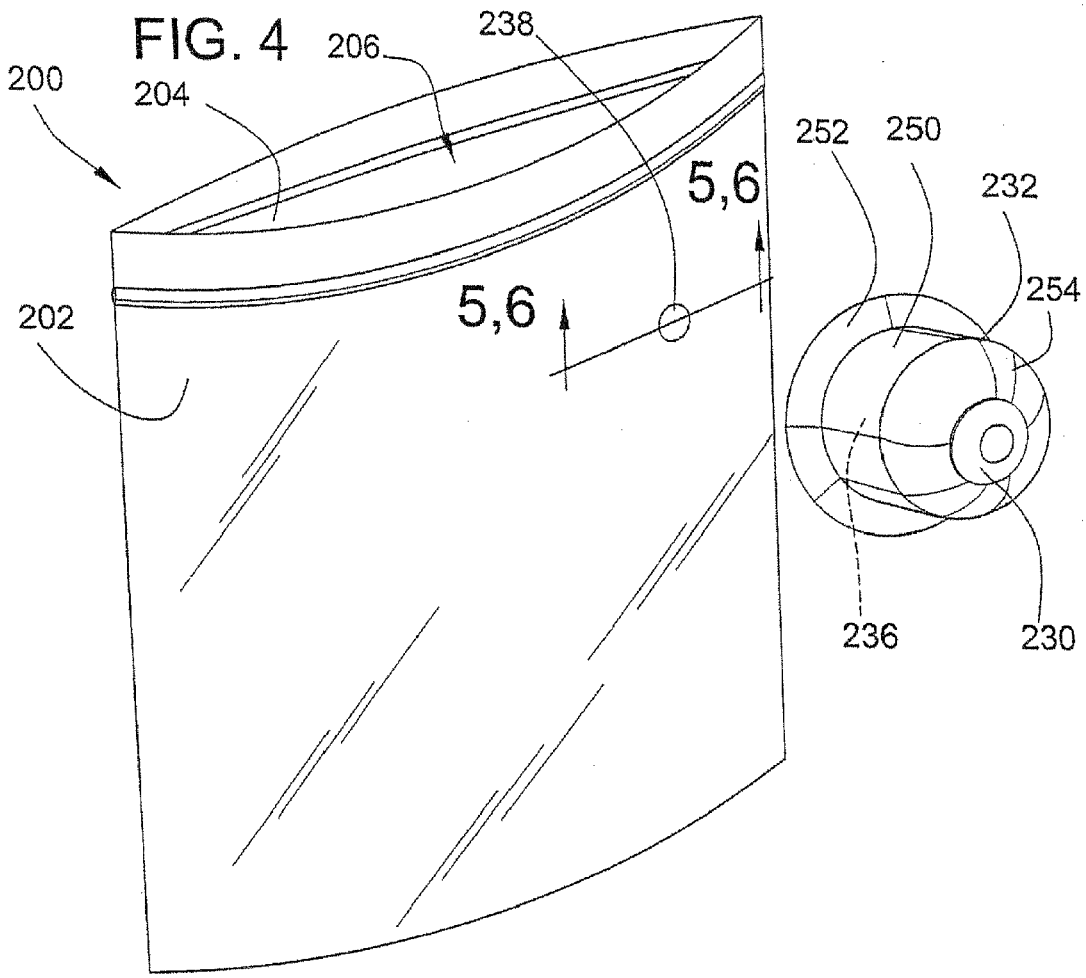
FIG. 4 is an exploded view of another embodiment of a storage bag having a one-way valve element and a separator for separating fluids and juices from evacuating air.

Referring to FIG. 4, there is illustrated another embodiment of a storage bag 200 wherein the separator 232 has a generally tubular shape and is formed separately from the material of the first sidewall 202. Specifically, in the illustrated embodiment, the separator 232 is formed as a cylindrically-shaped, tubular sleeve 250 of flexible or pliable thin-walled material that extends between a flanged base 252 and a closed cap 254. The sleeve 250 can be made from any suitable material including, for example, high density polyethylene, low density polyethylene, polypropylene, ethylene vinyl acetate, and can be formed in single or multiple layers. Moreover, the type of material can be the same as or different from the type of material used for the first and second sidewalls 202, 204. The tubular sleeve 250 defines and encloses a chamber 236 in which separation of fluids and juices from evacuating air can occur, as described above. The one-way valve element 230 is sealingly joined to the closed cap 254 to communicate with the chamber 236.

To operatively join the tubular-shaped separator 232 to the rest of the bag 200, a hole 238 that can be formed as a perforation, a plurality of perforations, a slit, cross, or other geometric shape is disposed through the first sidewall 202 to access the interior volume 206. The flanged base 252 is then placed against the first sidewall 202 so that the hole 238 aligns with the chamber 236 and the one-way valve element 230 is spaced-apart from the first sidewall. Any suitable method can be used to join the flanged base 252 to the first sidewall 202 including, for example, adhesives or heat sealing. Evacuating air from the interior volume 206 then passes across the hole 238 into the chamber 236 where separation occurs and exits through the valve element 230.

Figure 5:
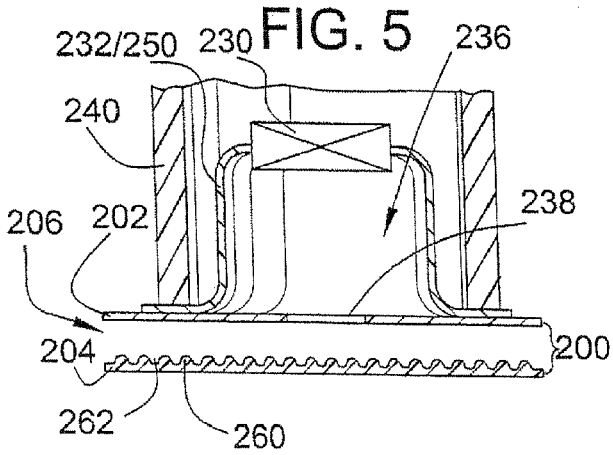
FIG. 5 is a cross-sectional view through the valve element and separator taken along line 5-5 of FIG. 1, the valve element and separator being acted upon by a nozzle during evacuation and the separator shown in an expanded position.
Figure 6:
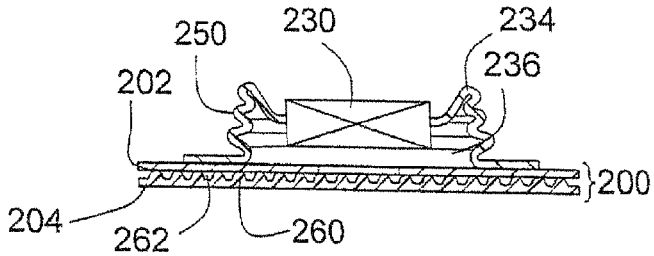
FIG. 6 is a cross-sectional view through the valve element and the separator as taken along line 6-6 of FIG. 4, the separator shown in a collapsed position.

Referring to FIGS. 5 and 6, the tubular-shaped separator 232 is preferably configured to switch between an expanded position and a collapsed position for simplifying packaging and distribution. As illustrated in FIG. 6, in the collapsed position, the excess material comprising the tubular sleeve 250 bunches up about the valve element 230 which is generally adjacent the first sidewall 202. When the separator 232 is in the collapsed position, the chamber 236 is by and large eliminated. Additionally, the first sidewall 202 can be flattened against the second sidewall 204 to substantially eliminate the interior volume.

Referring to FIG. 5, to expand the separator 232 and recreate the chamber 236, a pressure differential is applied across the first sidewall 202 proximate the valve element 230. The pressure differential may be created by applying a nozzle 240 attached to a vacuum generating device about the valve element 230. When the vacuum generating device is activated, the evacuating air drawn through the hole 238 expands the separator 232 into the tubular sleeve 250 thereby lifting and spacing the valve element 230 from the first sidewall 202. Hence, fluids and juices entrained in the evacuating air can be separated by the process described above within the chamber 236 before the air exits through the one-way valve element 230.

As illustrated in the embodiment of FIGS. 5 and 6, the bag 200 can include other features to facilitate evacuation of air from the interior volume 206. For example, the bag can include clearance members of the various types disclosed in U.S. patent application Ser. No. 10/880,784, filed on Jun. 29, 2004, and herein incorporated by reference in its entirety, for maintaining communication between the valve element and the interior volume. To provide one type of the aforementioned clearance members, the interior surface of the second sidewall 204 can include a plurality of elongated ribs 260 protruding toward the first sidewall 202. The ribs 260 define a plurality of channels 262 that can extend in any suitable pattern partially or completely across the interior surfaces of the bag 200. As will be appreciated by those of skill in the art, the inclusion of channels 262 can direct air toward the valve element 230 from various regions within the bag 200 during evacuation. Furthermore, the channels 262 are preferably sized so that the flexible material comprising the sidewalls 202, 204 will not clog the channels or otherwise block the flow of air toward the valve even when the sidewalls are collapsed together. Of course, it should be further appreciated that alternatively the channels 262 could be defined by grooves formed into the interior surface instead of ribs. Additionally, the channels 262 can be defined in either or both of the sidewalls. In other embodiments, the bag can include other rigid or compressible structures of the types disclosed in U.S. patent application Ser. No. 10/880,784 [Glad 492.464, LVM 228536] that function as standoffs.

Figure 7:
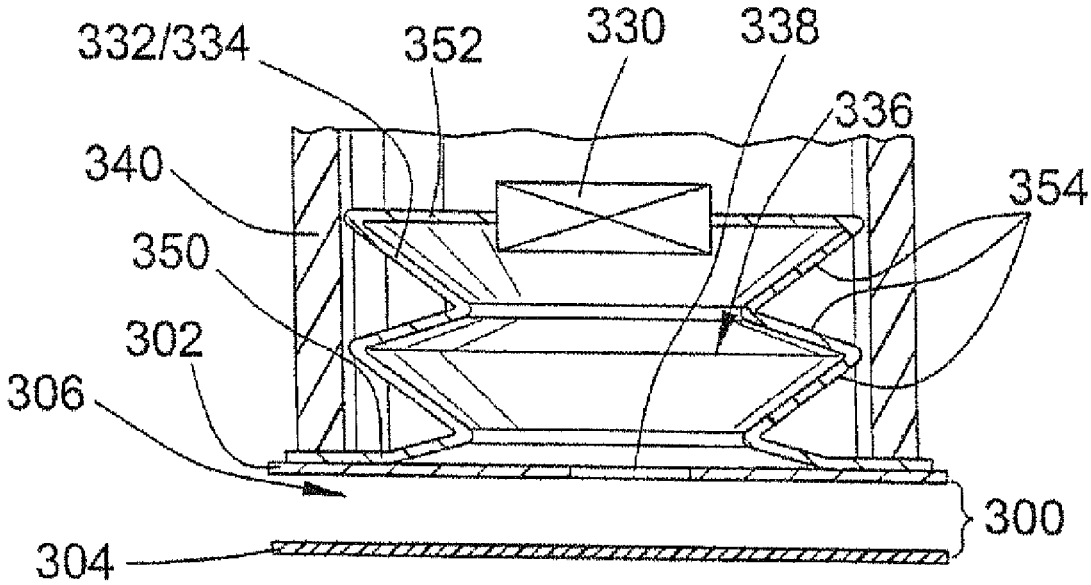
FIG. 7 is a cross-sectional view of another embodiment of the storage bag as taken through the valve element and the separator as being acted upon by a nozzle during evacuation, the separator shown in the expanded position.
Figure 8:
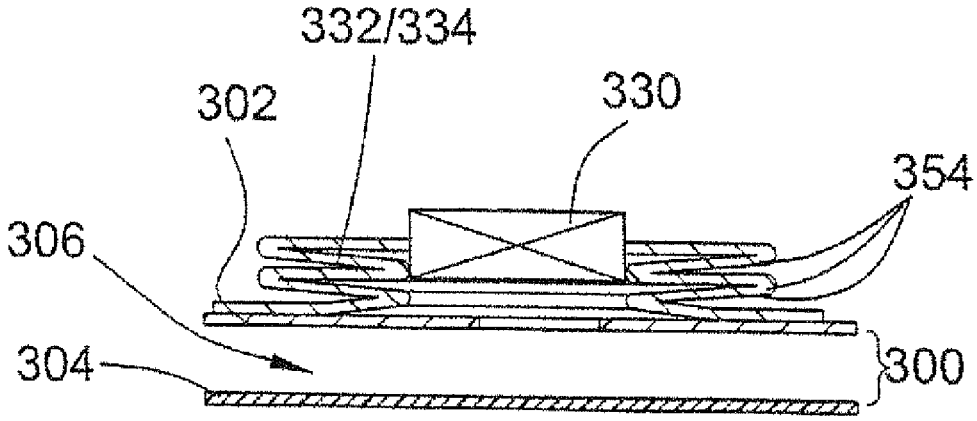
FIG. 8 is a cross-sectional view of the embodiment of the storage bag illustrated in FIG. 7 as taken through the valve element and the separator, the separator shown in the collapsed position.

Illustrated in FIGS. 7 and 8 is another embodiment of a storage bag 300 wherein the separator 332 is shaped as a bellows 334 and formed separately from the material of the first sidewall 302. The bellows 334 is a generally cylindrical, thin-walled tube having an opened flanged base 350 and an opposing closed cap 352. The tubular bellows 334 defines and encloses a chamber 336 in which separation of fluids and juices from evacuating air can occur, as described above. A one-way valve element 330 is sealingly joined to the end cap 352. A plurality of annular pleats 354 are formed into the tubular sidewall which allow the bellows 334 to expand and contract with respect to the first sidewall 302. The bellows 334 can be made from any suitable material including, for example, high density polyethylene, low density polyethylene, polypropylene, ethylene vinyl acetate, and can be formed in single or multiple layers.

To operatively connect the bellows with the rest of the bag 300, the flanged base 350 is adjacent to the first sidewall 302 about a hole 338 disposed therein and attached to the first sidewall by adhesives or heat-sealing. When the separator 332 is in the collapsed position, as illustrated in FIG. 8, the chamber 336 is substantially eliminated and the valve element 330 is moved generally adjacent to the first sidewall 302. The separator 332 is collapsed by folding together the annular pleats 354 which create the bellows 334. Moreover, the first and second sidewalls 302, 304 can be flattened together to eliminate the interior volume 306. When the separator 332 is in the expanded position, as achieved in FIG. 7 by expanding the bellows 334, the chamber 336 is created and raises or spaces the valve element 332 away from the first sidewall 302. Air from the interior volume 306 can pass through the hole 338 to enter the chamber 336 where fluids and juices can separate out in the above-described manner. The air can then exit the chamber 336 through the one-way valve element 330. To expand the separator 332 for enlarging the chamber 336, a pressure differential can be applied across the first sidewall 302 by applying a nozzle 340 communicating with a vacuum source about the separator and valve element 330.

Referring to FIGS. 9 and 10, there is illustrated another embodiment of a storage bag 400 wherein the separator is formed integrally with the first sidewall. In the illustrated embodiment, the bag 400 is produced by joining together a first sidewall 402 and a second sidewall 404 along a sealed first side edge 410, a parallel sealed second side edge 412, and a closed bottom edge 414 extending between the first and second side edges to define an interior volume 406. To access the interior volume 406, the top edges 420, 422 of the first and second sidewalls 402, 404 are not joined together and thereby provide an opening 424.

As illustrated in FIGS. 9, 10, 11, and 12, to create the separator 432, first and second opposing Z-folds 450, 452 are formed into the first sidewall 402 and extend parallel to each other generally between the first and second side edges 410, 412. The first and second Z-folds 450, 452 are arranged to provide parallel, adjoining first and second bends 454, 456 and are interconnected by a continuous strip of material 458 that is slightly spaced-apart from the plane of the first sidewall 402 by the Z-folds. The adjoining bends 454, 456 are located beneath the strip 458 of material. Two parallel, spaced-apart seals 460, 462 are formed into the strip 458 approximately midway between the first and second side edges 410, 412 to outline the protruding, square-shaped separator 432. The separator 432 encloses and defines an expandable and collapsible chamber 436 in which separation of fluids and juices from evacuating air can occur. The one-way valve element 430 is sealingly joined to the separator 432 to communicate with the chamber 436.

Figure 11:
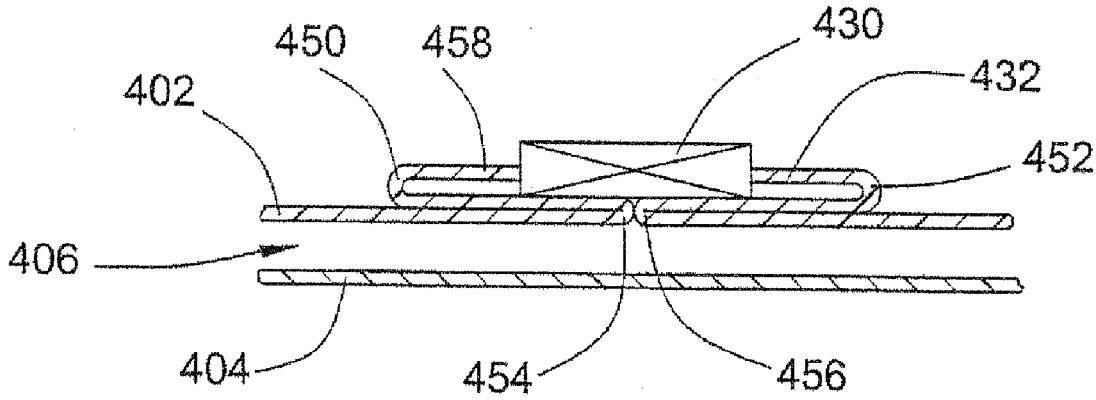
FIG. 11 is a cross-sectional view through the valve element and separator taken along line 11-11 of FIG. 9 with the separator shown in the collapsed position.
Figure 12:
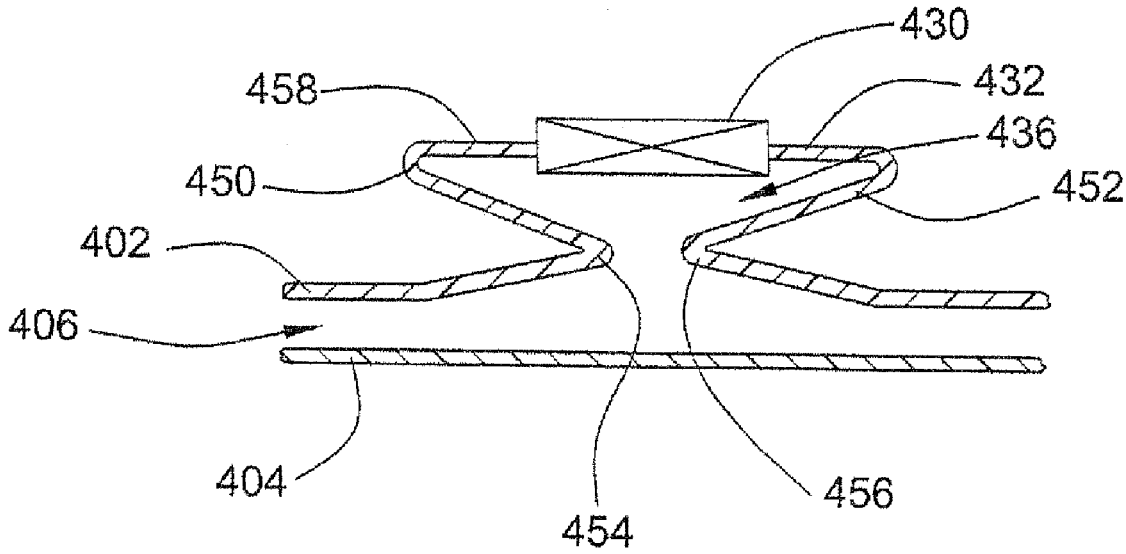
FIG. 12 is a cross-sectional view through the valve element and separator taken along line 12-12 of FIG. 9 with the separator shown in the expanded position.

Referring to FIGS. 11 and 12, it will be appreciated that, during evacuation of the interior volume, air must pass between the adjoining bends 454, 456 of the Z-folds 450, 452 to enter the separator 432. Once in the separator 432, the evacuating air will cause the chamber 436 to expand by slightly raising the strip 458 with respect to the adjoining bends 454, 456. Fluids and juices can separate from the evacuating air inside the expanded chamber 436 in the above-described fashion and be returned to the interior volume 406 while the air exits through the one-way valve element 430.

The one-way valve element 130, 230, 330, 430 can have any suitable design. For example, referring to the embodiment illustrated in FIG. 9, the one-way valve element 430 includes a flexible base layer 470 that cooperates with a resilient top layer 472 to open and close the valve element. The base and top layers 470, 472 can be made from any suitable material such as, for example, thermoplastic film. Disposed through the center of the base layer 470 is an aperture 474, thus providing the base layer with an annular shape. The top layer 472 is tautly stretched over and adhered to the base layer 470 by parallel strips of adhesive 476 that extend along either side of the aperture 474, thereby covering the aperture with the top layer and forming a channel between the adhesive strips. The base layer 470 and top layer 472 are then adhered over a hole disposed through the separator 432 for accessing the chamber 436.

As will be appreciated by those of skill in the art, when a pressure differential is created across the valve element 430, the top layer 472 will be partially separated from the base layer 470 thereby creating a channel or space between the base layer 470 and the top layer 472. Air escaping the interior chamber 436 can enter into the channel between the base layer 470 and the top layer 472 and thereby escape into the environment. Of course, in other embodiments, the one-way valve element can have a different construction. For example, in another embodiment, the base layer 470 is eliminated and is not part of the valve element. In other embodiments, the valve element may be a rigid body with a translating valve disk that opens and closes a hole disposed through the body.

Figure 13:
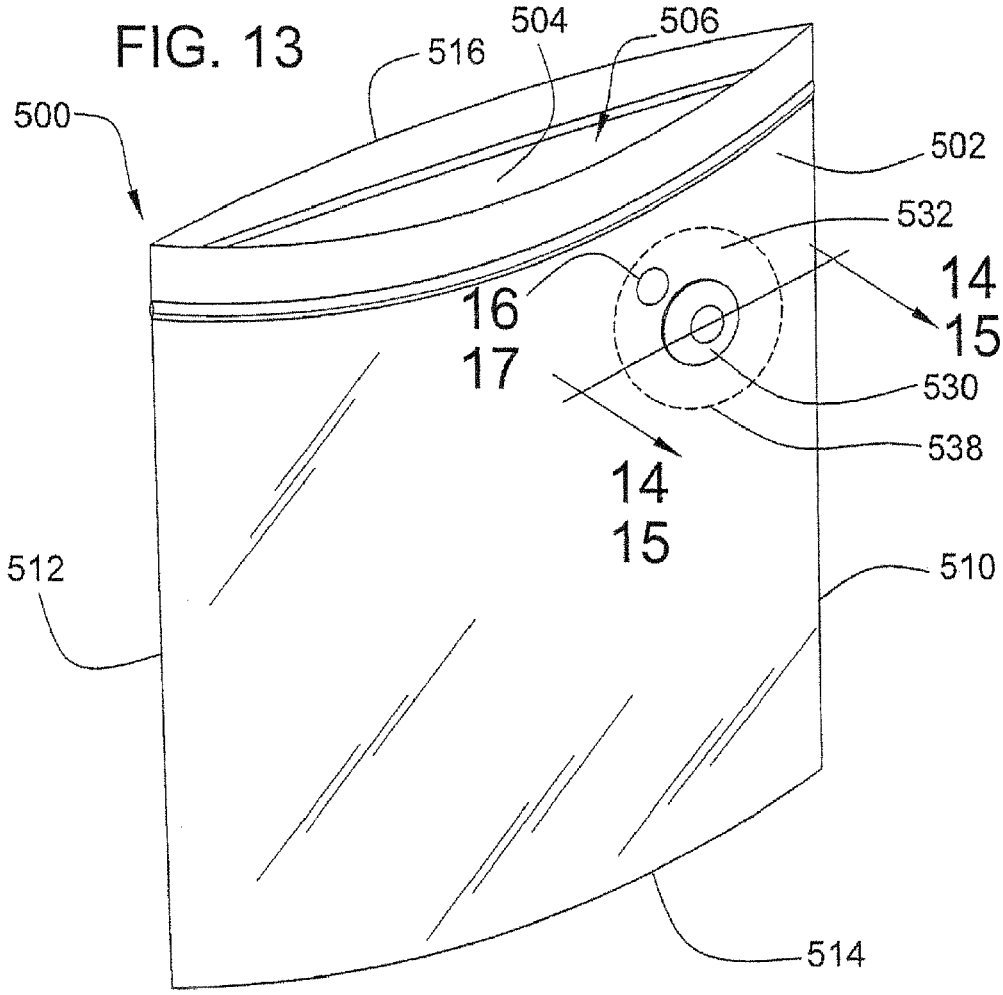
FIG. 13 is a perspective view of another embodiment of the storage bag having a one-way valve element attached to a separator comprising a region of increased elasticity.

Referring to FIG. 13, there is illustrated an embodiment of a storage bag 500 wherein separation of fluids and juices occurs by way of a region of elastically expandable material 532 joined to the first sidewall 502 with the one-way valve element 530 attached to the region. As described above, the first sidewall is joined to a second sidewall 504 along first and second side edges 510, 512 and a closed bottom edge 514 to provide an interior volume 506 accessible via an opened top end 516. The elastic region 532 is capable of expanding and recovering with respect to the first sidewall 502. In its typical recovered position, illustrated in FIG. 15, the elastic region 532 appears as a smooth continuous sheet with the surrounding material of the first sidewall 502 and the valve element 530 is generally located within the plane of the first sidewall. Since the elastic region 532 appears as a smooth, continuous sheet and is preferably taut around the valve element 530, the storage bag 500 has an aesthetically pleasing appearance.

Figure 14:
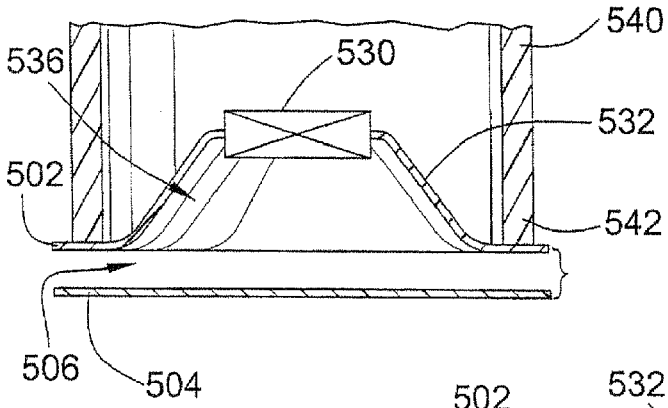
FIG. 14 is a cross-sectional view through the valve element and the separator as taken along line 14-14 of FIG. 13, the valve element and separator being acted upon by a nozzle during evacuation and the separator shown in an expanded position.

When placed in the expanded position, as illustrated in FIG. 14, the material of the elastic region 532 elastically expands with respect to the first sidewall 502 to move the valve element 530 apart from the plane of the first sidewall. Furthermore, the elastic region 532 when in the expanded position provides an enclosed chamber 536 that communicates between the interior volume 506 and the valve element 530. Separation of fluids and juices from air evacuating from the interior volume 506 through the valve element 530 occurs in the chamber 536 according to the above-described manner.

To enable the elastic region 532 to expand and recover with respect to the first sidewall 502, the material within the region is characterized by increased elasticity with respect to the material of the first and second sidewalls 502, 504. The increased elasticity of the region 532 can be provided in any suitable way. For example, the material within the region can be made with a thickness between the interior and exterior surfaces that is less than the material thickness from the rest of the sidewall. Another way of increasing elasticity is to make the region of a distinct material which demonstrates a higher modulus of elasticity with respect to the remaining material of the first sidewall. In various embodiments, the elastic material can be formed separately and physically joined to the sidewall material or can be integrally molded into the sheet of sidewall material. Yet another technique is to emboss all or part of the material within the region so that the region is more likely to bend or elastically expand.

Figure 16:
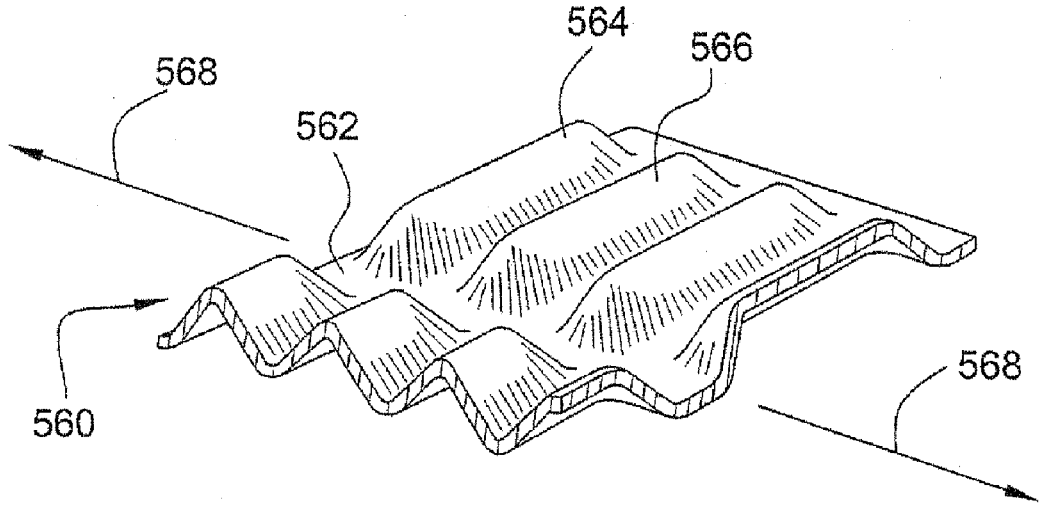
FIG. 16 is a detailed perspective view of the area indicated in FIG. 13 illustrating one type of suitable material for making the elastic region, the material being in a substantially untensioned condition.
Figure 17:
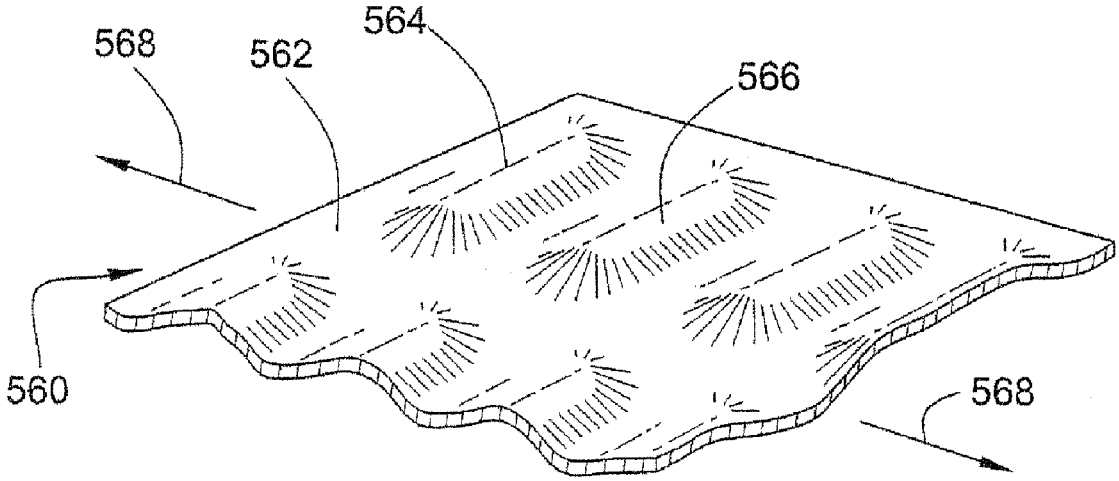
FIG. 17 is a detailed perspective view of the area indicated in FIG. 13 illustrating the suitable material for making the elastic region, the material being in a partially-tensioned condition.

Referring to FIGS. 16 and 17, there is illustrated one type of material 560 characterized by an increased elasticity that is suitable for making the elastic region of storage bag. The material of this type is disclosed in U.S. Pat. No. 6,394,652 to Meyer et al., herein incorporated by reference in its entirety. As disclosed in U.S. Pat. No. 6,394,652, the material 560 can have a "strainable network" that includes a plurality of first regions 562 and a plurality of second regions 564. The second regions 564 can be formed by embossing raised, rib-like elements 566 into the material so that the second regions and first regions appear bunched or contracted together in the untensioned state illustrated in FIG. 16. When a pulling force is applied, as indicted by the arrows 568 in FIG. 17, the rib-like elements 566 are able to unbend or geometrically deform so that the first and second regions 562, 564 become substantially coplanar with each other. As will be appreciated, this action stretches or elongates the material 560.

The elastic region 532 can have any suitable shape. As illustrated in the embodiment of FIG. 13, the elastic region 532 can have a circular shape, the circumference of which is indicated by 538 and to which the valve element 530 is concentrically attached. The border or circumference 538 of the elastic region 532 can either be visibly demarcated to indicate to users the location of the region or may remain invisible. Moreover, the elastic region 532 can have any proportional size with respect to the size of the first sidewall 502. For example, the elastic region can be a small area adjacent the valve element or can be coextensive with the first sidewall. When the circular elastic region 532 is made to expand, as illustrated in FIG. 14, the elastic region can have a generally hemispherical or domed shape with the valve element 530 generally located at the apex. In other embodiments, the elastic region can be provided in the form of a strip.

Referring to FIG. 14, in an exemplary use, the rim 542 of a tubular nozzle 540 is placed against the first sidewall 502 to generally surround the valve element 530 while the opposite end of the nozzle communicates with a vacuum source. The rim 542 can have a circular shape dimensionally corresponding to the diameter of the elastic region 532, though in other embodiments, the elastic region can be larger or smaller than the nozzle rim. Once the vacuum source is activated, it will be appreciated that because of the choking effect of the valve element 530, pressure will be reduced inside the nozzle 540 at a faster rate than the pressure reduction within the interior volume 506. This applies a pressure differential across the interior and exterior surfaces of the first sidewall 502 including the elastic region 532. Due to the forces exerted by the pressure differential, the elastic material elastically expands into the tubular nozzle 540 thereby moving the valve element 530 from the plane of the first sidewall 502 and simultaneously creating the chamber 536 in which fluids and juice can separate.

Figure 15:
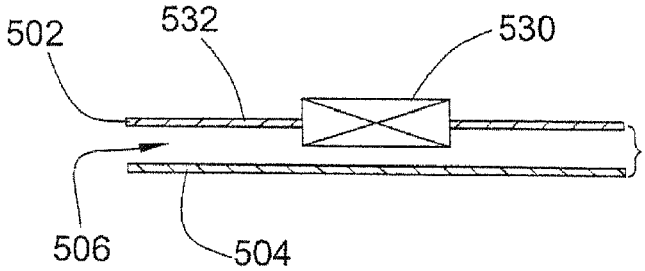
FIG. 15 is a cross-sectional view through the valve element and the elastic region as taken along line 15-15 of FIG. 13, the elastic region shown in a collapsed position.

Once the vacuum source creating the pressure differential is removed, for example, by removing the nozzle or completing evacuation of the interior volume 506, the elastic region 532 recovers back to the recovered position illustrated in FIG. 15 thereby eliminating the chamber. Additionally, the elastic region 532 appears as a smooth continuation of the sheet material of the first sidewall 502. The storage bag 500 therefore has an aesthetically pleasing appearance and is easier to package in stacks of multiple bags.

It will be appreciated by those of skill in the art that, by increasing the size of the elastic region 532 and the corresponding nozzle rim 542, the resistance of the elastic region against expanding decreases. For example, referring to FIG. 14, to move the valve element 530 to a given height with respect to the sidewall 502, the elastic material must elongate or expand with respect to the original size of the elastic region. This can be characterized generally by the following formula, where H=height, $A_{orig.}$=original area of region, and $A_{exp.}$=expanded area of region:

$$H \approx (A_{exp.} - A_{orig.}) A_{orig.}$$

It will be appreciated that if the height remains constant and the original area of the elastic region 532 increases, the total percentage of elongation within the region to achieve that height decreases. Hence, the elastic material undergoes less strain and incurs a lesser chance of permanently deforming.

Figure 18:
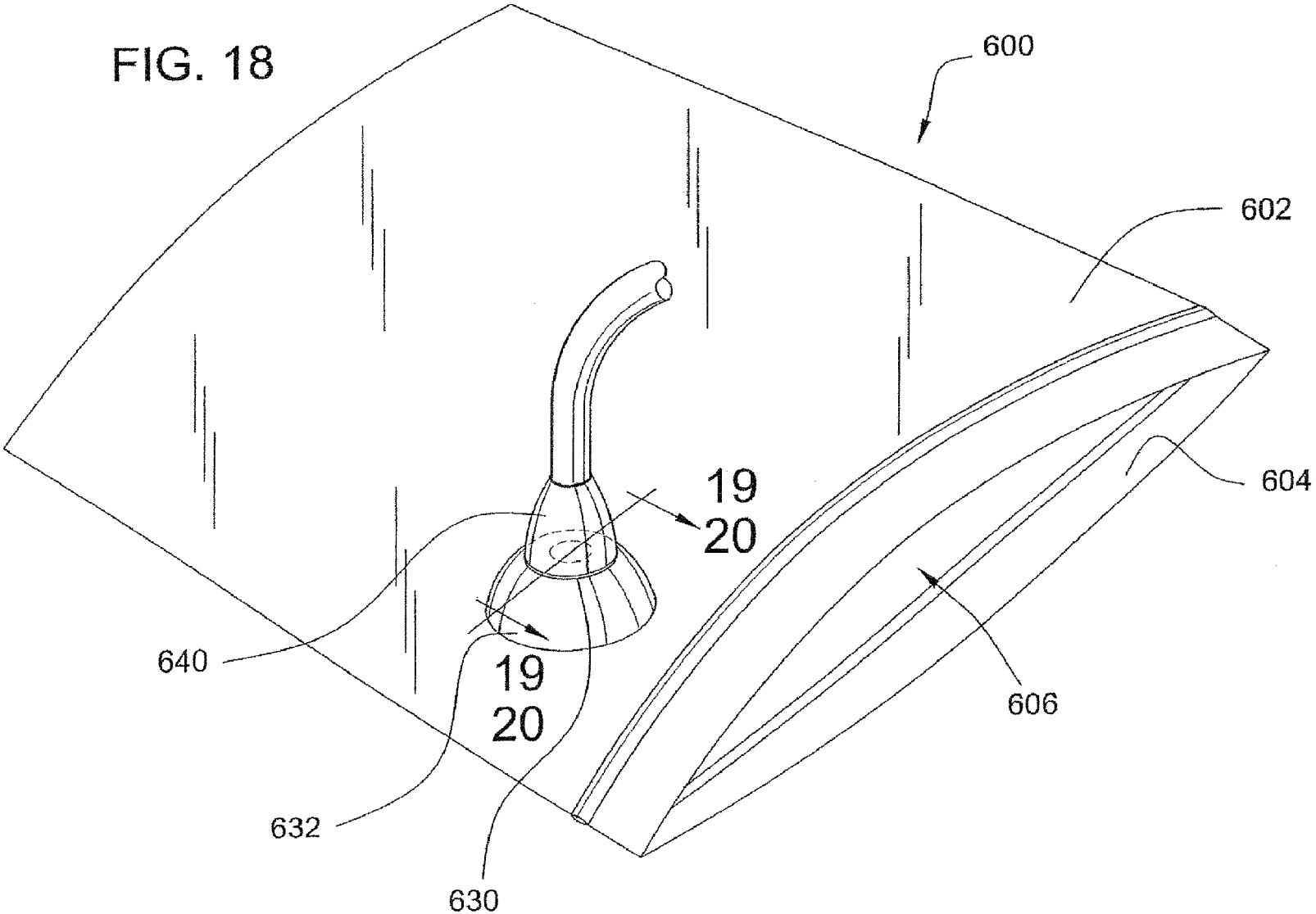
FIG. 18 is a perspective view of another embodiment of the storage bag having a nozzle directly engaging a one-way valve element attached to a separator comprising a region of increased elasticity.

Referring to FIGS. 18, there is illustrated another embodiment of a storage bag 600 having a region 632 of elastic material capable of expanding and recovering with respect to a first sidewall 602. The one-way valve element 630 is attached to the elastic region and communicates with the interior volume 606 provided between the first and second sidewalls 602, 604. In the illustrated embodiment, during use, the nozzle 640 of a vacuum apparatus engages directly to the one-way valve element 630 rather than being placed against the first sidewall 602 surrounding the valve element 630. Engaging the nozzle 640 and valve element 630 allows a user to pull the elastic region 632 from the recovered position illustrated in FIG. 19 to the expanded position shown in FIG. 20. When in the expanded position, the elastic region 632 moves the valve element 630 out of the plane of the sidewall 602 and provides the chamber 636 for separating fluids and juices. To allow the elastic region 632 to recover, the pulling force on the nozzle 640 is simply released.

Figure 19:
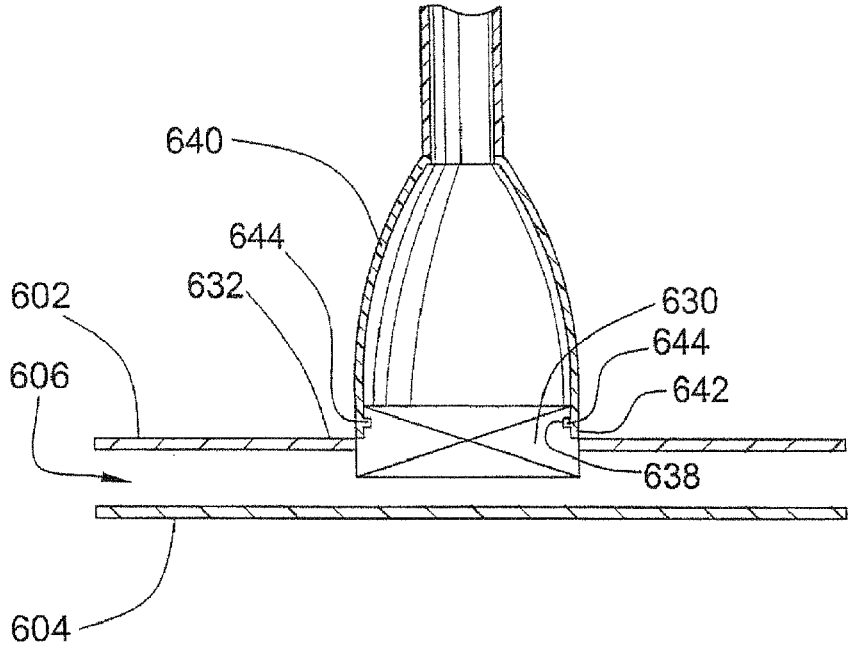
FIG. 19 is a cross-sectional view through the valve element and the separator as taken along line 19-19 of FIG. 18, the elastic region shown in a recovered position.
Figure 20:
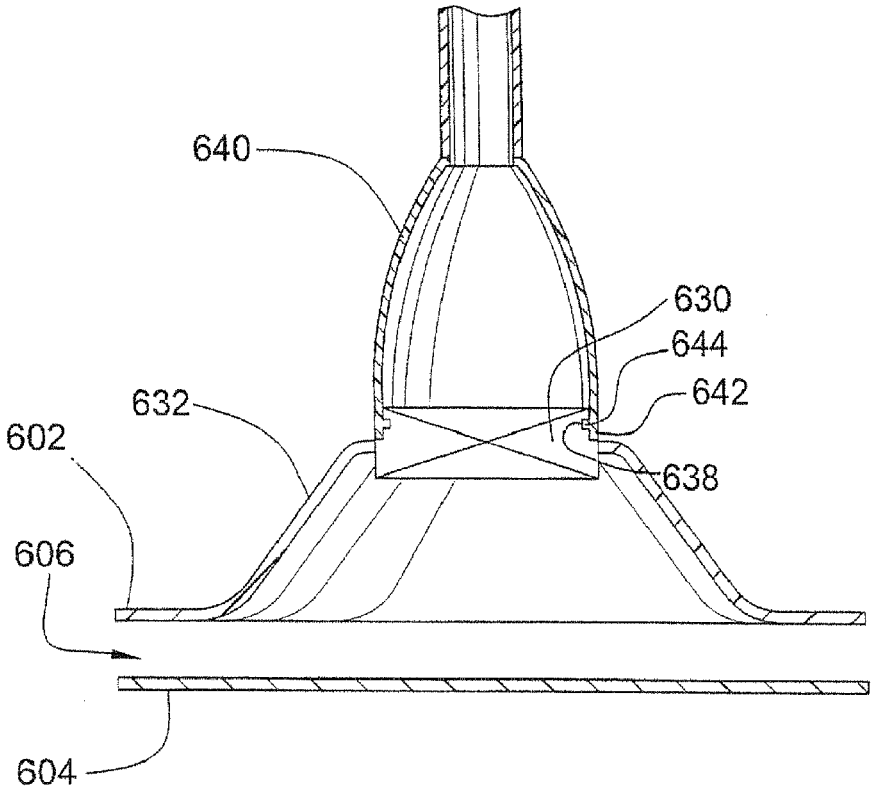
FIG. 20 is a cross-sectional view through the valve element and the elastic region as taken along line 20-20 of FIG. 18 with the elastic region shown pulled into the expanded position.

Referring to FIG. 19, in an embodiment, the one-way valve element 630 and the nozzle 640 can mechanically engage each other. To accomplish this, the nozzle has a rim 642 that sized to slide over the valve element 630 and can include an inner protruding rib 644 formed proximate the rim. The inner protruding rib 644 can be received in a corresponding groove 638 formed about the peripheral edge of the valve element 630. The groove 638 and rib 644 form a snap-fit relationship when the rim 642 is pressed over the valve element 630.

Figure 21:
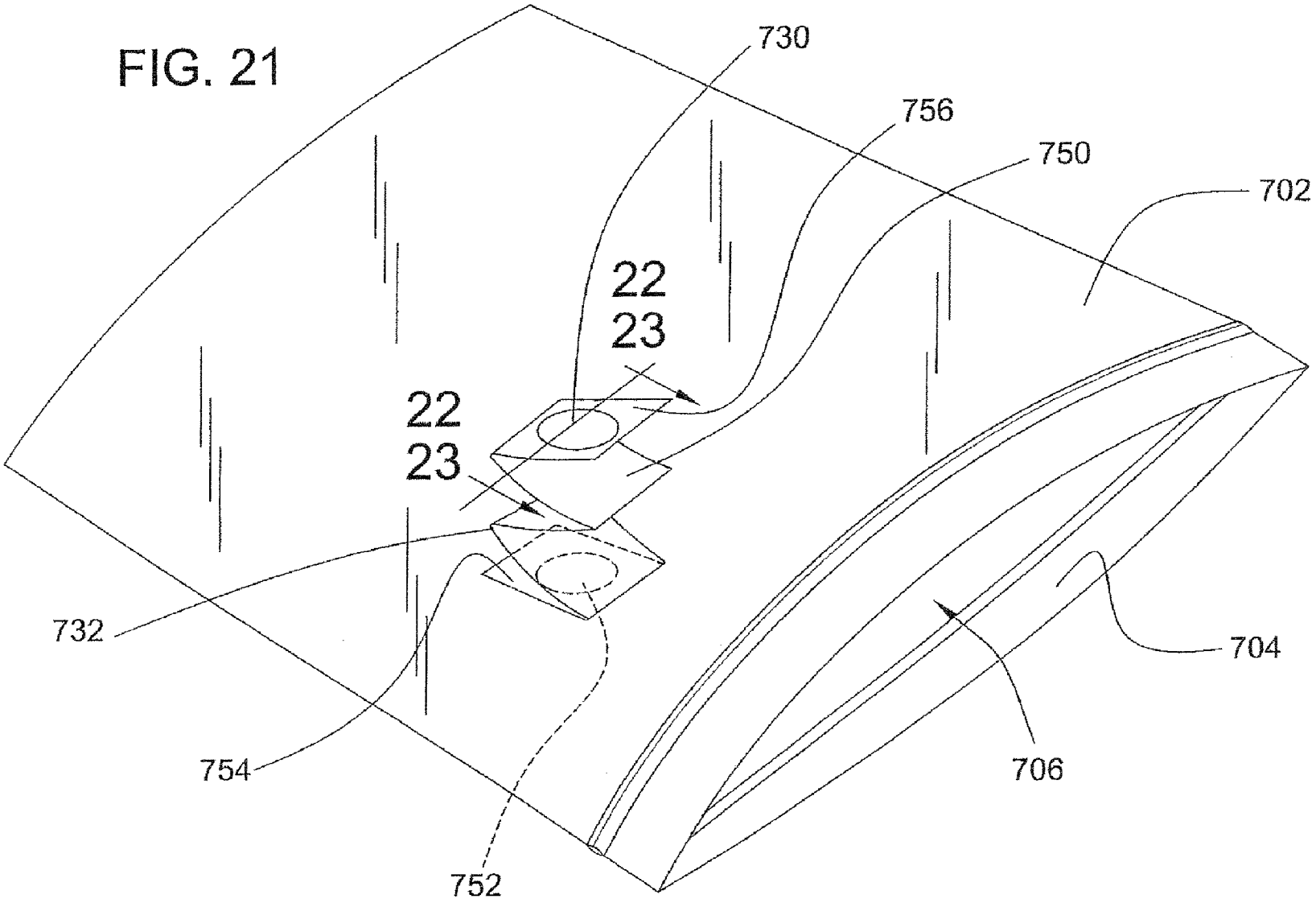
FIG. 21 is a perspective view of another embodiment of the storage bag having a one-way valve element and a separator for separating fluids and juices from evacuating air, where the separator is provided by an elongated tube foldable with respect to the sidewall.
Figure 22:
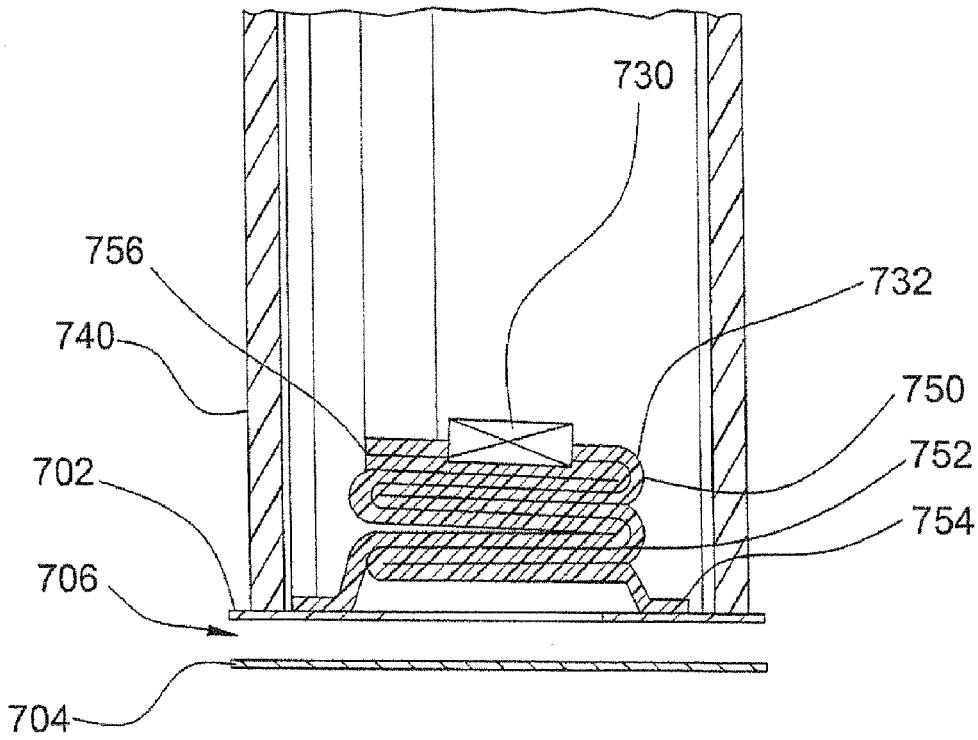
FIG. 22 is a cross-sectional view through the valve element and the separator as taken along line 22-22 of FIG. 21, the separator shown in a collapsed position.

Referring to FIG. 21, there is illustrated another embodiment of storage bag 700 wherein the separator 732 is formed as an elongated flat tube of flexible material that is capable of folding upon itself with respect to the first sidewall 702. The separator 732 includes a tubular body 750 that provides a channel 752 extending between a flanged base 754 attachable to the first side wall 702 and a closed distal end 756. In the illustrated embodiment, the distal end 756 can be closed by sealing together the ends of the flat tubular body 750. The valve element 730 is attached to the tubular body proximate the distal end 756 and communicates with the channel 752. When in the collapsed position, as illustrated in FIG. 22, the separator 732 generally folds upon itself and the first sidewall 702 in multiple layers. Moreover, any channel 752 developed by the tubular body 750 is eliminated.

Figure 23:
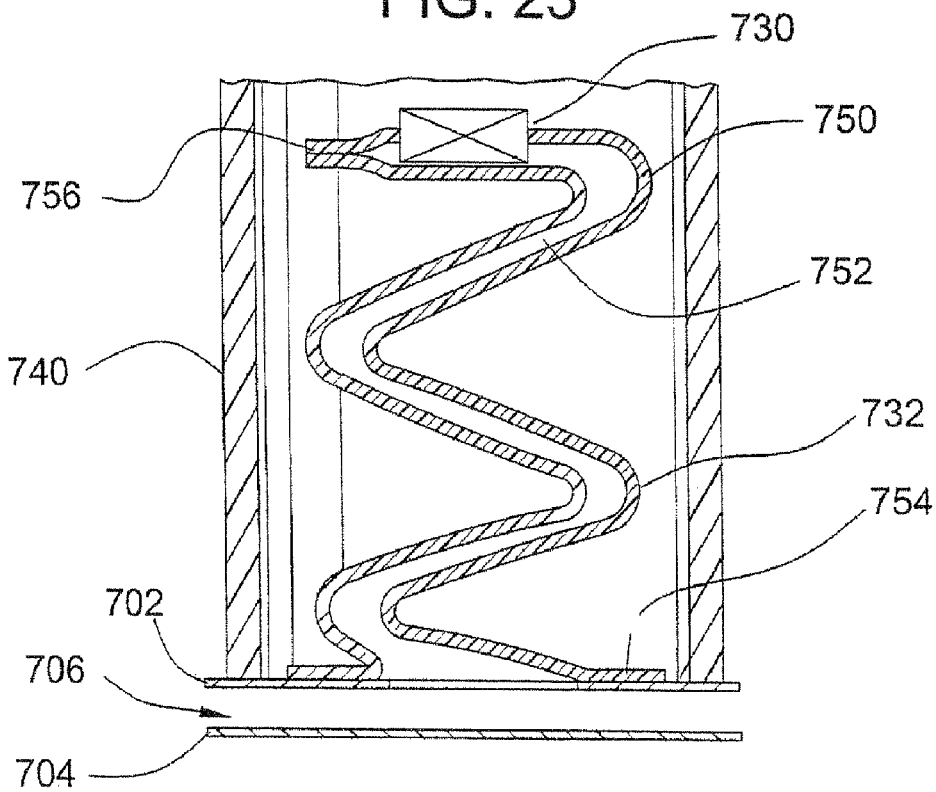
FIG. 23 is a cross-sectional view through the valve element and the separator as taken along line 23-23 of FIG. 21, with the valve element and separator being acted upon by a nozzle during evacuation and the separator shown in an expanded position.

As illustrated in FIG. 23, when a nozzle 740 which is connected to a vacuum source is placed about the separator 732 and the vacuum source is activated, the tubular body 750 expands to the expanded position within the nozzle. This causes the channel 752 to open allowing communication between the valve element 730 and the interior volume 706. Hence, air can be evacuated from the interior volume. It will be appreciated that even in the expanded position, the tubular body 750 imparts a tortuous path upon the channel 752 which further aids in separation of fluids and juices. After evacuation, the separator 732 can fold back against the first sidewall 702 as illustrated in FIG. 22.

Referring to FIGS. 24, 25, and 26, the one-way valve element 800 for use with a storage bag of the foregoing type can include a rigid valve body 810 that cooperates with a movable disk 812 to open and close the valve element. The valve body 810 includes a circular flange portion 814 extending between parallel first and second flange faces 820, 822. Concentric to the flange portion 814 and projecting from the second flange face 822 is a circular boss portion 818 which terminates in a planar boss face 824 that is parallel to the first and second flange faces. The circular boss portion 818 is smaller in diameter than the flange portion 814 so that the outermost annular rim of the second flange face 822 remains exposed. The valve body 810 can be made from any suitable material such as a moldable thermoplastic material like nylon, HDPE, high impact polystyrene (HIPS), polycarbonates (PC), and the like.

Disposed concentrically into the valve body 810 is a counter-bore 828. The counter-bore 828 extends from the first flange face 820 part way towards the boss face 824. The counter-bore 828 defines a cylindrical bore wall 830. Because it extends only part way toward the boss face 824, the counter-bore 828 forms within the valve body 810 a preferably planar valve seat 832. To establish fluid communication across the valve body 810, there is disposed through the valve seat 832 at least one aperture 834. In fact, in the illustrated embodiment, a plurality of apertures 834 are arranged concentrically and spaced inwardly from the cylindrical bore wall 830.

To cooperatively accommodate the movable disk 812, the disk is inserted into the counter-bore 828. Accordingly, the disk 812 is preferably smaller in diameter than the counter-bore 828 and has a thickness as measured between a first disk face 840 and a second disk face 842 that is substantially less than the length of the counter-bore 828 between the first flange face 820 and the valve seat 832. To retain the disk 812 within the counter-bore 828, there is formed proximate to the first flange face 820 a plurality of radially inward extending fingers 844. The disk 812 can be made from any suitable material such as, for example, a resilient elastomer.

Referring to FIG. 26, when the disk 812 within the counter-bore 828 is moved adjacent to the fingers 844, the valve element 800 is in its open configuration allowing air to communicate between the first flange face 820 and the boss face 824. However, when the disk 812 is adjacent the valve seat 832 thereby covering the apertures 834, the valve element 800 is in its closed configuration. To assist in sealing the disk 812 over the apertures 834, a sealing liquid can be applied to the valve seat 832. Furthermore, a foam or other resilient member may be placed in the counter-bore 828 to provide a tight fit of the disk 812 and the valve seat 832 in the closed position.

To attach the valve element 800 to the first sidewall, referring to FIG. 25, an adhesive can be applied to the exposed annular rim portion of the second flange face 822. The valve element 800 can then be placed adjacent the exterior surface of the first sidewall with the boss portion 818 being received through the hole disposed into the sidewall and thereby pass into the internal volume. Of course, in other embodiments, adhesive can be placed on other portions of the valve element, such as the first flange face, prior to attachment to the sidewall.

In other embodiments, the one-way valve element can have a different construction. For example, the one-way valve element can be constructed from flexible film materials similar to those disclosed in U.S. Pat. No. 2,927,722, U.S. Pat. No. 2,946,502, and U.S. Pat. No. 2,821,338, all incorporated by reference in their entirety.

Figure 27:
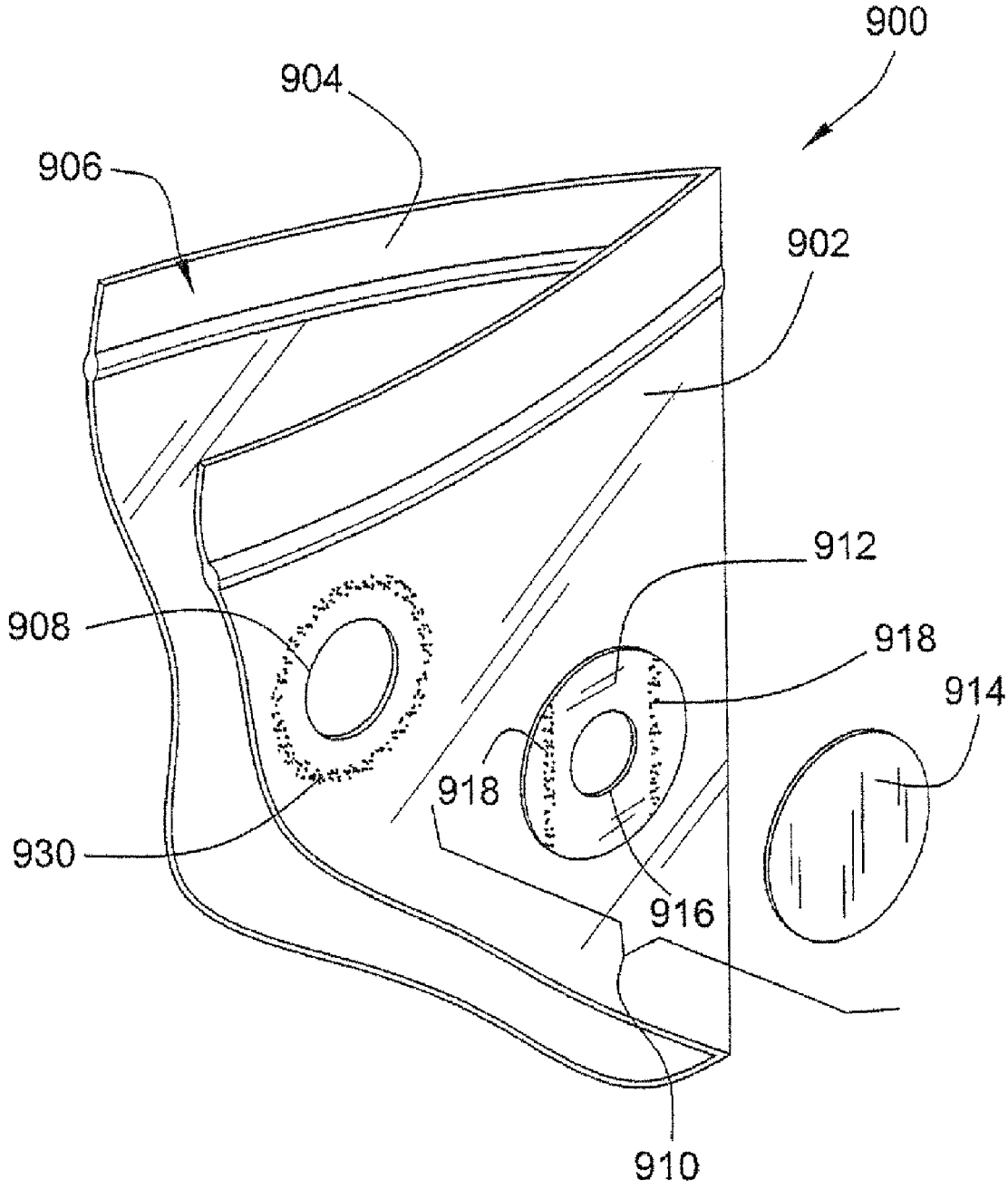
FIG. 27 is an exploded view of another embodiment of the one-way valve element for attachment to the flexible bag.

As illustrated in FIG. 27, such a flexible one-way valve element 910 made in accordance with this style can include a flexible, circular base layer 912 that cooperates with a correspondingly circular shaped, resilient top layer 914 to open and close the valve element. The top and bottom layers can be made from any suitable material such as, for example, a flexible thermoplastic film. Disposed through the center of the base layer 912 is an aperture 916, thus providing the base layer with an annular shape. The top layer 914 is placed over and adhered to the base layer 912 by two parallel strips of adhesive 918 that extend along either side of the aperture 916, thereby covering the aperture with the top layer and forming a channel. The base layer 912 is then adhered by a ring of adhesive 930 to the flexible bag 900 so as to cover the hole 908 disposed through the first sidewall 902.

As will be appreciated by those of skill in the art, when the sidewalls 902, 904 of the bag 900 are forcibly compressed together, air from the internal volume 906 will pass through the hole 908 and the aperture 916 thereby partially displacing the top layer 914 from the base layer 912. The air can then pass along the channel formed between the adhesive strips 918 and escape to the environment. When the force on the sidewalls 902, 904 is released, the resilient top layer 914 will return to its prior configuration covering and sealing the aperture 916. The valve element 910 may also contain a viscous material such as an oil, grease, or lubricant between the two layers in order to prevent air from reentering the bag. In an embodiment, base layer 912 may also be a rigid sheet material.

Figure 28:
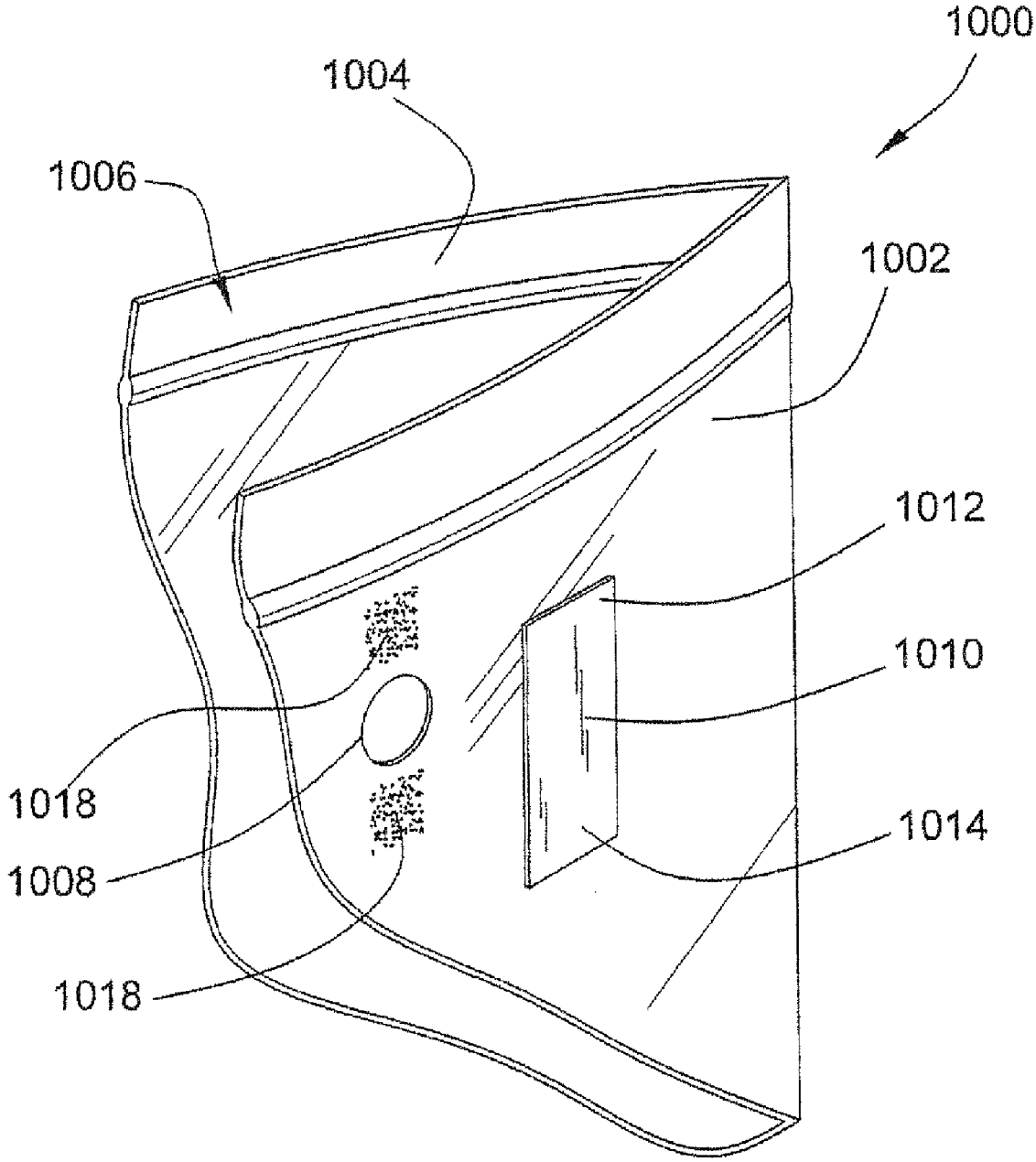
FIG. 28 is an exploded view of another embodiment of the one-way valve element for attachment to the flexible bag.

Illustrated in FIG. 28 is another embodiment of the valve element 1010 that can be attached to the flexible plastic bag 1000. The valve element 1010 is a rectangular piece of flexible thermoplastic film that includes a first end 1012 and a second end 1014. The valve element 1010 is attached to the first sidewall 1002 so as to cover and seal a hole 1008 disposed through the first sidewall. The valve element 1010 can be attached to the sidewall 1002 by patches of adhesive 1018 placed on either side of the hole 1008 so as to correspond to the first and second ends 1012, 1014. When the sidewalls 1002, 1004 of the flexible bag 1000 are collapsed together, air from the internal volume 1006 displaces the flexible valve element 1010 so as to unseal the hole 1008. After evacuation of air from the internal volume 1006, the valve element 1010 will again cover and seal the hole 1008.

Figure 29:
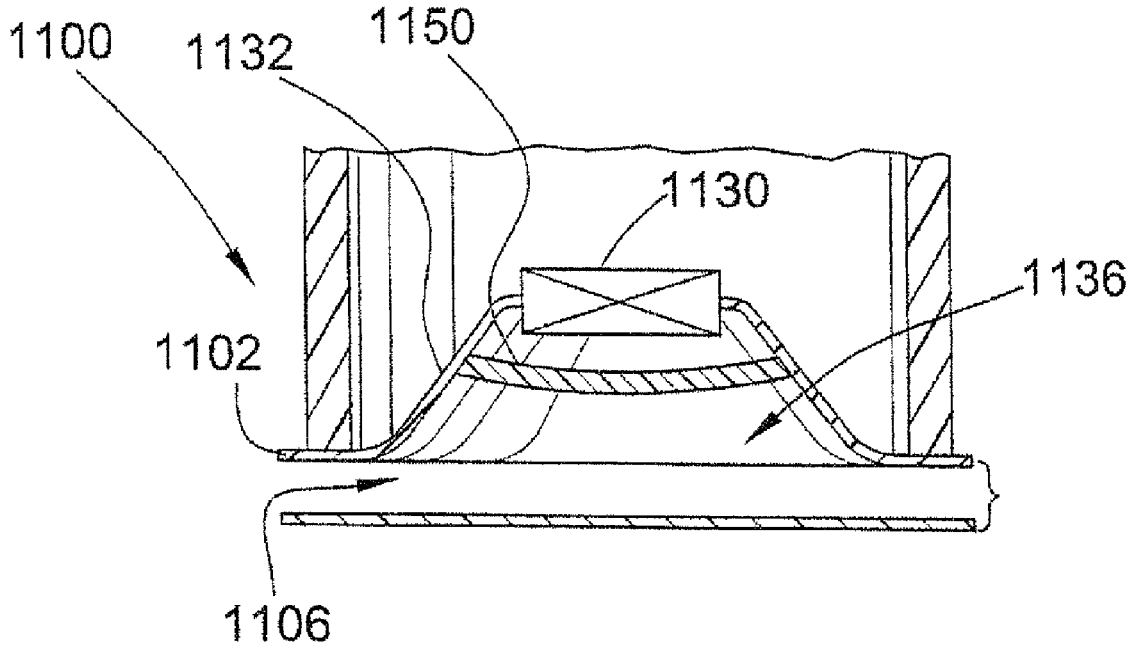
FIG. 29 is a cross-sectional view of a valve element and an expanded separator similar to that illustrated in FIG. 14 with a barrier element for separating fluids and juices from evacuating air.

The storage bag can be configured with additional features for separating fluids and juices from air being evacuated through the one-way valve element. For example, as illustrated in FIG. 29, the storage bag 1100 can include a non-woven or similar material that is provided as a barrier element 1150. The non-woven material can be any suitable material such as, but not limited to, melt blown, spun bond, hydroentangled, needle punched, batting, dry-laid or wet-laid. The barrier element 1150 is located within the bag 1100 so as to separate that one-way valve element 1130 from the interior volume 1106 provided between the first and second sidewalls 1102, 1104. For instance, in the illustrated embodiment, the barrier element 1150 can be attached to a portion of the elastic region 1132 that forms the enclosed chamber 1136 when expanded from the first sidewall 1102. In other embodiments, the barrier element 1150 can be attached directly to the valve element 1130 itself. As will be appreciated, air exhausting from the interior volume 1106 will encounter the barrier element 1150 prior to encountering the valve element 1130. The non-woven or similar material of the barrier element 1150 is permeable to the passage of air or other gasses but resistive to the passage of fluids so that the barrier element can function to further separate fluids from the evacuating air. In various embodiments, the barrier element 1150 can be treated with a hydrophobic or hydrophilic substance to further improve the fluid separation effect.

Figure 30:
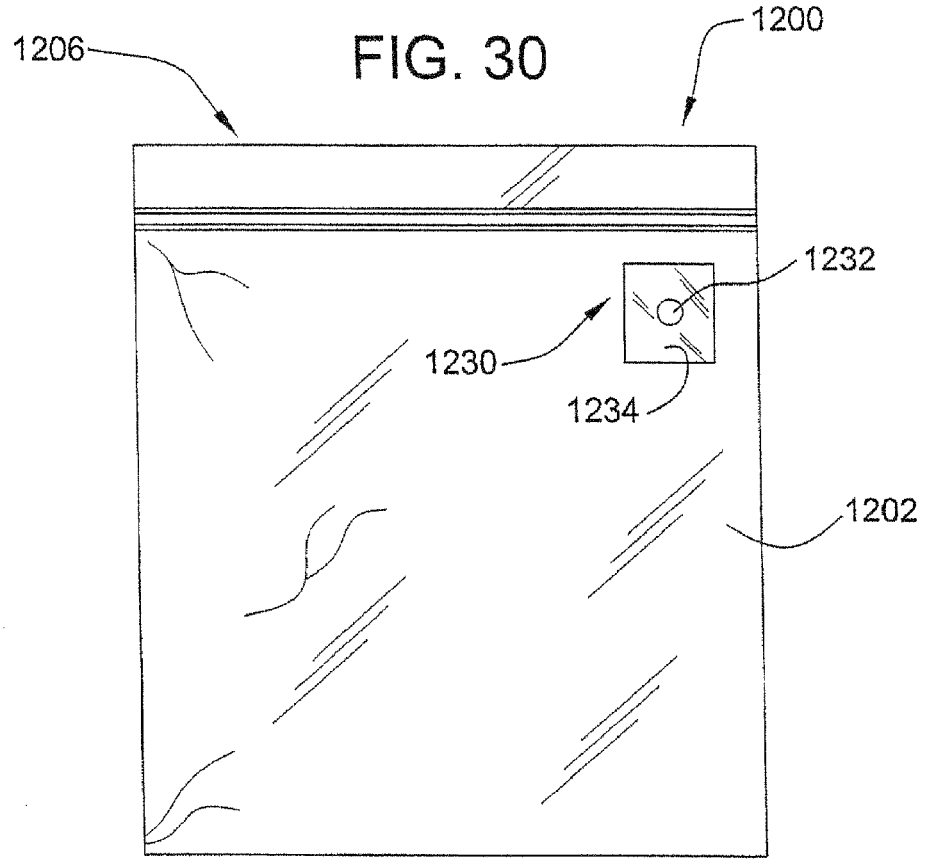
FIG. 30 is a front plan view of a storage bag configured with a porous layer extending over a hole disposed through the sidewall.

In other embodiments, the valve element can be comprised from a combination of porous and non-porous layers such as those disclosed in International patent application PCT/US2003/020478, filed on Jun. 27, 2003, and herein incorporated by reference in its entirety. A valve element 1230 of this type as attached to a storage bag 1200 is disclosed in FIG. 30. The valve element 1230 is provided over an aperture 1232 disposed into the first sidewall 1202 of the storage bag 1200 that communicates with the interior volume 1206. The valve element 1230 includes porous layer 1234 that is attached directly over the aperture 1232. To evacuate the interior volume 1206, the storage bag is 1200 is compressed or otherwise manipulated to force excess air to move through the porous layer 1234 and thus exit through the aperture 1232. The porous layer 1234 can be made from any suitable material including, for example, a non-woven polymer such as spun bond, melt blown, or spun bond—melt blown—spun bond polyethylene. In other embodiments, the porous layer can be made from a foam material having an open cell structure such as foamed polyethylene.

Figure 31:
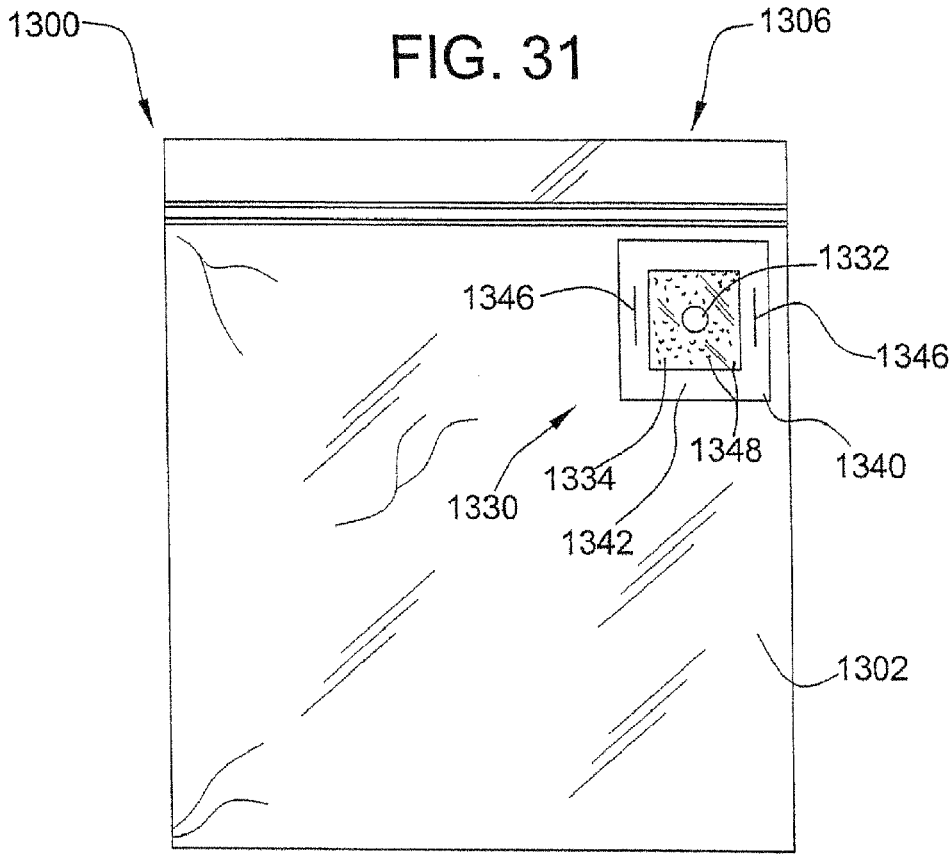
FIG. 31 is a front plan view of a storage bag configured with a porous layer and a non-porous layer extending over a hole disposed through the sidewall.
Figure 32:
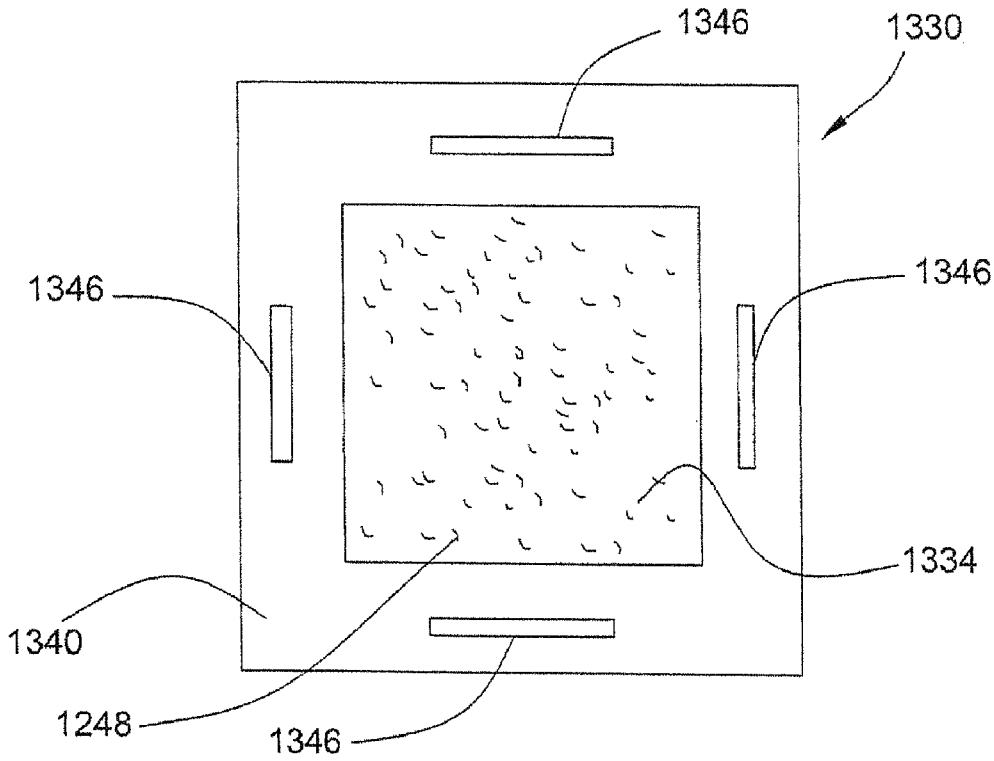
FIG. 32 is an enlarged plan view of an embodiment of the porous and non-porous layers of FIG. 31.
Figure 33:
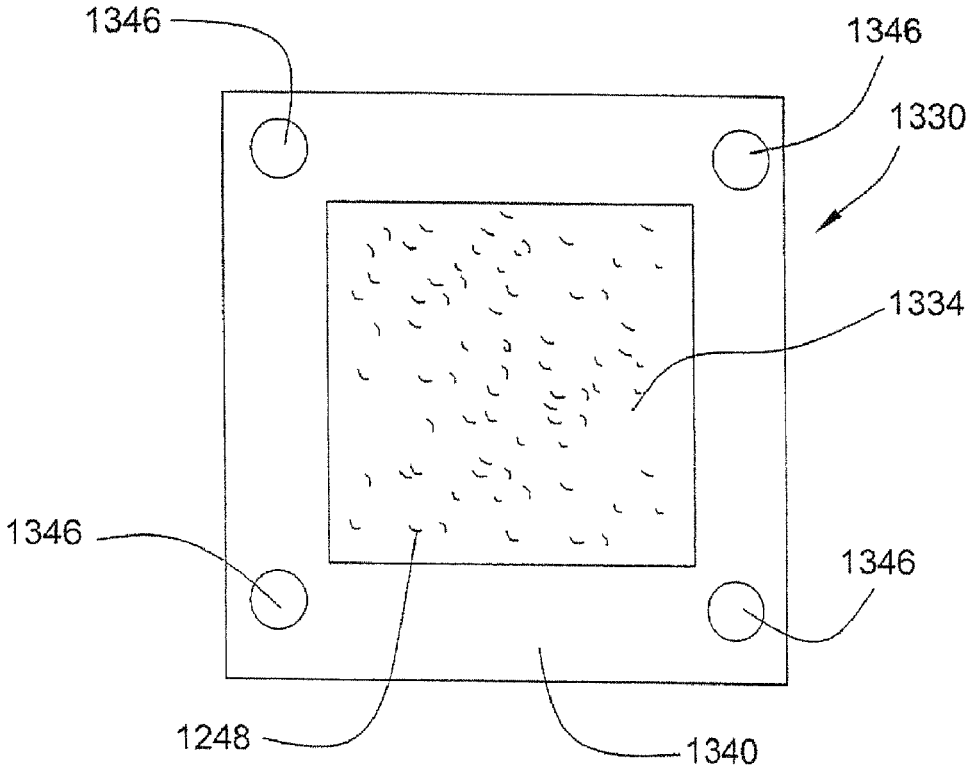
FIG. 33 is an enlarged plan view of another embodiment of the porous and non-porous layers of FIG. 31.

Referring to the storage bag 1300 illustrated in FIG. 31, in further embodiments, the valve element 1330 can also include a non-porous layer 1340 in addition to the porous layer 1334. The non-porous layer 1340 extends adjacently over the porous layer 1334 and is attached to the first sidewall 1302 by its peripheral edges 1342. Hence, the non-porous layer also extends over the aperture 1332. The non-porous layer 1340 also has disposed through it one or more perforations 1346. In the embodiment illustrated in FIG. 32 the perforations 1346 are straight slits in the side edges 1342 of the non-porous layer 1340 while in the embodiment illustrated in FIG. 33 the perforations are circular apertures disposed proximate the outer corners of the non-porous layer. When the storage bag 1300 is manipulated, excess air in the interior volume will pass through the aperture 1332 and the porous element 1334. The exiting air will displace the non-porous layer 1340 with respect to the porous layer 1334 and can thereby exit through the perforations 1346. After the excess air has exited, the non-porous layer 1340 can resiliently settle adjacent to the porous layer 1334 to close the aperture 1332.

A potential benefit of providing the non-porous layer 1340 is its ability to substantially prevent liquid within the interior volume from exiting the storage bag 1300. Specifically, if the liquid within the interior volume passes through the aperture 1332 and the porous layer 1334, it encounters the non-porous layer 1340. The liquid causes the porous layer 1334 and the non-porous layer 1340 to adhere together due to surface tension. As a result, the liquid cannot access the perforations 1346 to exit the storage bag. To further improve the liquid retaining features of the valve element, in other embodiments, the porous layer 1334 can include absorbent or super-absorbent particles 1248 disposed therein. Liquids entrained in excess air moving though porous layer 1334 will be absorbed by the particles 1248.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of evacuating a storage bag comprising:

(i) providing a bag including first and second flexible sidewalls defining an interior volume, the bag including an opening for accessing the interior volume, the first sidewall having a region of increased elasticity, and a one-way valve element within the region and communicating with the interior volume;

(ii) closing the opening;

(iii) applying a vacuum source about the one-way valve element;

(iv) expanding the region from a elastically recovered position to an elastically expanded position to define a chamber;

(v) separating fluids from air in the chamber; and (vi) exhausting air from the chamber through the one-way valve element.

2. The method of claim 1, further comprising:

(vii) removing the vacuum source from about the one-way valve element; and (viii) returning the region to the elastically recovered position.

3. The method of claim 1, wherein the step of separating fluids from air occurs by gravitational separation.

* * * * *